US009290022B2

(12) United States Patent
Makabe

(10) Patent No.: US 9,290,022 B2
(45) Date of Patent: Mar. 22, 2016

(54) RECEIPT PRINTING DEVICE HAVING IMPROVED RECORDING AND CUTTING OPERATION

(75) Inventor: Tomokazu Makabe, Ueda (JP)

(73) Assignee: Seiko Epson Corporation, Tokyo (JP)

( * ) Notice: Subject to any disclaimer, the term of this patent is extended or adjusted under 35 U.S.C. 154(b) by 200 days.

(21) Appl. No.: 13/454,527

(22) Filed: Apr. 24, 2012

(65) Prior Publication Data

US 2012/0274953 A1 Nov. 1, 2012

(30) Foreign Application Priority Data

Apr. 28, 2011 (JP) ..... 2011-101049

(51) Int. Cl.
*B41J 11/66* (2006.01)
*B41J 11/42* (2006.01)

(52) U.S. Cl.
CPC ..... *B41J 11/663* (2013.01); *B41J 11/42* (2013.01)

(58) Field of Classification Search
CPC ..... B41J 11/663; B41J 15/042
USPC ..... 358/1.13, 1.5, 1.18, 1.15; 400/621
See application file for complete search history.

(56) References Cited

U.S. PATENT DOCUMENTS

| | | | | |
|---|---|---|---|---|
| 6,648,034 | B1 | 11/2003 | Birtcher et al. | |
| 6,966,348 | B2 | 11/2005 | Steidl et al. | |
| 2005/0271446 | A1 * | 12/2005 | Minowa | 400/621 |
| 2009/0141308 | A1 * | 6/2009 | Inada et al. | 358/1.18 |
| 2009/0168094 | A1 * | 7/2009 | Horiuchi et al. | 358/1.15 |
| 2011/0004530 | A1 | 1/2011 | Miyagawa et al. | |
| 2012/0274961 | A1 * | 11/2012 | Makabe | 358/1.11 |

FOREIGN PATENT DOCUMENTS

| | | | |
|---|---|---|---|
| CN | 1702696 | A | 11/2005 |
| CN | 101944259 | A | 1/2011 |
| JP | 2004-058323 | A | 2/2004 |
| JP | 2005-059502 | A | 3/2005 |
| JP | 2005-223310 | A | 8/2005 |
| JP | 2005-288778 | A | 10/2005 |
| JP | 2007-047898 | A | 2/2007 |
| JP | 2007047898 | A * | 2/2007 |
| JP | 2009-132068 | A | 6/2009 |

* cited by examiner

*Primary Examiner* — Jacky X Zheng
(74) *Attorney, Agent, or Firm* — Kilpatrick Townsend & Stockton LLP

(57) ABSTRACT

A specific operation based on specific data that is received for recording to a recording medium can be performed and the best recording result can be achieved without changing the control device as much as possible. When a string recording command specifying a string containing a specific string is contained in recording data, the recording control unit 60 of the printer 2 performs a predetermined operation as an operation corresponding to the specific string timed to execution of the operation related to the string recording command.

24 Claims, 14 Drawing Sheets

RECEIPT PRINTING DEVICE HAVING IMPROVED RECORDING AND CUTTING OPERATION

This application claims priority to Japanese Patent Application No. 2011-101049, filed Apr. 28, 2011, the entirety of which is incorporated by reference herein.

BACKGROUND

1. Technical Field

The present invention relates to a recording device capable of connecting to a control device, a recording device control method, and a storage medium storing a program for controlling the recording device.

2. Related Art

Recording devices such as printers that are connectable to a control device such as a host computer and record on a recording medium by means of a recording head (printhead) are known from the literature. See, for example, Japanese Unexamined Patent Appl. Pub. JP-A-2005-59502.

The recording device then records on the recording medium based on the data (which may include commands) received from the control device. The expected printout may not be achieved in this case if the control device side does not have sufficient information about the actual mechanics of the recording device. However, the desired printout can be achieved if specific operations are performed appropriately at specific times instead of simply executing the received commands (data) as received. This can also improve the performance of the recording device.

However, in order to change the operation whereby the recording device according to the related art records on recording media, the data output from the control device to the recording device must be changed, and the control device must therefore be modified in some particular way. Modifying the control device, however, can be relatively complicated, and involves some time and expense. The need to modify the control device is therefore preferably avoided as much as possible.

SUMMARY

The present invention enables controlling the recording device when recording to perform a specific operation so that the best recording result can be achieved without modifying the control device as much as possible.

One aspect of the invention is a recording device that is capable of connecting to a control device, and includes: a recording head that records on a recording medium; a conveyance unit that conveys the recording medium in a conveyance direction; a reception unit that receives data (which may include commands) from the control device; a recording control unit that controls the recording head and the conveyance unit and records on the recording medium based on the data received by the reception unit; and a settings unit that stores specific data related to a specific operation; wherein the recording control unit determines if the specific data stored in the settings unit is contained in the data received by the reception unit, and if the specific data is contained, executes the specific operation related to the specific data in the settings unit.

In order to perform a specific operation when specific data, such as a specific string, is contained in data (recording data), this aspect of the invention enables the recording device to perform specific operations related to the string, for example, such as an operation of a mechanism included in the recording device, according to the status of recording a string in the data, for example, to the recording medium while recording to the recording medium. More particularly, because the control device can output data as usual to the recording device, and the recording device side automatically performs a specific mechanical operation timed to recording the specific string, there is no need to modify the control device.

Preferably, the settings unit stores the specific operation linked to a specific timing for performing the specific operation; and when the specific data stored in the settings unit is contained in the data received by the reception unit, the recording control unit performs the specific operation linked to the specific data in the settings unit at the specific timing related to the specific operation in the settings unit.

This aspect of the invention enables the recording device to automatically perform a specific mechanical operation at a specific time according to the received specific data.

In another aspect of the invention, the recording device also has a cutting unit that cuts the recording medium; the settings unit stores first specific data related to a recording medium cutting operation of the cutting unit; and the recording control unit cuts the recording medium by the cutting unit based on the cutting operation linked to the specific data in the settings unit when the first specific data stored in the settings unit is contained in the data received by the reception unit.

This aspect of the invention enables the recording device to automatically cut the recording medium by the cutting unit according to the received first specific data.

In another aspect of the invention, the settings unit stores the cutting operation related to a specific timing for cutting the recording medium by the cutting unit based on the cutting operation; and when the first specific data stored in the settings unit is contained in the data received by the reception unit, the recording control unit causes the cutting unit to cut the recording medium at the specific timing related to the cutting operation in the settings unit.

This aspect of the invention enables the recording device to automatically cut the recording medium by the cutting unit at a specific time according to the received first specific data.

Further preferably in another aspect of the invention, when the first specific data stored in the settings unit is contained in the data received by the reception unit, the recording control unit causes the cutting unit to cut the recording medium based on the cutting operation related to the first specific data in the settings unit at a specific timing referenced to the timing when the first specific data is recorded to the recording medium by the recording head.

This aspect of the invention enables the recording device to cut the recording medium at an appropriate position by cutting at an appropriate time based on the status of recording a string in the data on the recording medium.

A recording device according to another aspect of the invention preferably also has a cutting unit that cuts the recording medium; and a header image information storage unit that stores data including at least the first specific data received by the reception unit. The settings unit stores the first specific data stored by the header image information storage unit related to a recording medium cutting operation of the cutting unit; and when the first specific data stored in the header image information storage unit is contained in the data received by the reception unit, the recording control unit cuts the recording medium by the cutting unit based on the cutting operation related to the first specific data in the settings unit at a specific timing referenced to the timing when the recording head records the first specific data.

This aspect of the invention stores first specific data that is normally received and recorded at a specific position when recording a receipt, such as data that is recorded to a specific position on the receipt, and to cut the recording medium at an appropriate position by cutting the recording medium referenced to the specific position when the first specific data is recorded.

In another aspect of the invention, the cutting unit is located on the downstream side in the recording medium conveyance direction from the recording head; and when the first specific data stored in the header image information storage unit is contained in the data received by the reception unit, the recording control unit cuts the recording medium by the cutting unit based on the cutting operation related to the first specific data in the settings unit timed to the conveyance unit conveying the recording medium a specific distance after recording at least the first specific data.

In another aspect of the invention, the specific distance the conveyance unit conveys the recording medium is equal to the distance between the recording head and the cutting unit.

If the recording medium is cut without being advanced after recording on the recording medium by the recording head, the recording medium may be cut through the trailing end of the printout on the recording medium because the cutting unit is on the downstream side of the recording head. This aspect of the invention avoids cutting through the recorded content because the recording medium is cut after advancing the end of the recorded content past the cutting unit.

In this case, if fixed data recorded in the header of the next receipt, such as the store name, is prerecorded on the recording medium, and part of the header data is the first specific data, the beginning of the next receipt can be recorded continuously to the end of the previous receipt, the recording medium can be cut precisely when the boundary therebetween reaches the cutting position, wasted white space due to paper conveyance can be prevented between receipts, and wasting recording media can be avoided.

The margin that is formed between the leading end of the recording medium and the leading end of the image recorded on the recording medium when cutting the recording medium due to the distance in the conveyance direction between the recording head and the cutting unit can thus be reduced, and the following is possible. That is, because cutting the recording medium by the cutting unit is triggered by recording one specific string in the group of strings for one or plural lines stored in the header image information storage unit, the recording medium can be cut at the appropriate time by appropriately specifying the string that triggers cutting.

A recording device according to another aspect of the invention preferably also has a cutting unit that cuts the recording medium and is disposed on the downstream side in the recording medium conveyance direction from the recording head; the settings unit stores first specific data related to an operating sequence that cuts the recording medium by the cutting unit after the conveyance unit conveys the recording medium a specific conveyance distance; and when the first specific data stored in the settings unit is contained in the data received by the reception unit, the recording control unit, triggered by recording the first specific data, performs a specific operation related to the first specific data in the settings unit.

This aspect of the invention enables the recording device to cut after conveying the recording medium a specific conveyance distance at an appropriate time based on recording a string or other data in the recording data to the recording medium.

In a recording device according to another aspect of the invention, the specific conveyance distance is the distance between the cutting unit and the recording head in the conveyance direction.

By conveying the recording medium, this aspect of the invention enables avoiding cutting through the printout on the recording medium due to the distance in the conveyance direction between the recording head and the cutting unit.

In a recording device according to another aspect of the invention, the settings unit stores first specific data related to conveyance of the recording medium by the conveyance unit; and when the first specific data is contained in the data received by the reception unit, the recording control unit conveys the recording medium by the conveyance unit according to the first specific data in the settings unit at a specific time referenced to the timing of the recording head recording the first specific data on the recording medium.

This aspect of the invention enables the recording device to convey the recording medium at an appropriate time based on the result of recording first specific data, such as a string, in the recording data on the recording medium. As a result, a space can be created after a specific string, for example. The printout can also be advanced and removed.

Further preferably, the recording device also has a warning unit; the settings unit stores first specific data related to a warning by the warning unit; and when the first specific data is contained in the data received by the reception unit, the recording control unit issues a warning by the warning unit related to the first specific data in the settings unit.

This aspect of the invention enables the recording device to issue a warning by the warning unit at an appropriate time based on the result of recording a specific string in the recording data, for example.

Further preferably, the warning unit issues a warning by outputting sound or displaying information.

This aspect of the invention enables outputting sound or displaying information at an appropriate time based on the result of recording a specific string in the recording data, for example.

Further preferably, the settings unit stores the specific data related to the specific operation based on a specific command received from the control device.

This aspect of the invention enables relating specific data to a specific operation by issuing a command from the control device, and improves convenience.

Further preferably, when a command specifying the specific operation is received from the control device, the recording control unit does not execute the specific operation based on the command specifying the specific operation.

Because the specific operation is performed automatically on the recording device side, repeatedly executing a command from the control device specifying a specific operation can be avoided.

Further preferably, when a command specifying the cutting operation is received from the control device, the recording control unit does not perform the cutting operation based on the command specifying the cutting operation.

Because the cutting operation is performed automatically on the recording device side, repeatedly executing a cut command from the control device can be avoided.

Further preferably, when a command specifying conveyance of the recording medium is received from the control device, the recording control unit does not convey the recording medium based on the command specifying conveyance of the recording medium.

Because the conveyance operation is performed automatically on the recording device side, repeatedly executing a conveyance command from the control device can be avoided.

Another aspect of the invention is a method of controlling a recording device that is capable of connecting to a control device and includes a recording head that records on a recording medium, a conveyance unit that conveys the recording medium, a reception unit that receives data from the control device, and a settings unit that stores specific data related to a specific operation, the control method including steps of: receiving the data by the reception unit; determining if the specific data stored in the settings unit is contained in the received data; and executing the specific operation related to the specific data in the settings unit if the specific data is contained.

In order to perform a specific operation when specific data, such as a specific string, is contained in data (recording data), this method enables the recording device to perform specific operations related to the string, for example, such as an operation of a mechanism included in the recording device, according to the status of recording a string in the data, for example, to the recording medium while recording to the recording medium. More particularly, because the control device can output data as usual to the recording device, and the recording device side automatically performs a specific mechanical operation timed to recording the specific string, there is no need to modify the control device.

Another aspect of the invention is a storage medium storing a program executed by a control unit that controls parts of a recording device that is capable of connecting to a control device and includes a recording head that records on a recording medium, a conveyance unit that conveys the recording medium, a reception unit that receives data from the control device, and a settings unit that stores specific data related to a specific operation, the program causing the control unit to function as a recording control unit that executes the specific operation related to the specific data in the settings unit when the specific data stored in the settings unit is contained in the data received by the reception unit.

In order to perforin a specific operation when specific data, such as a specific string, is contained in data (recording data), executing the program according to this aspect of the invention enables the recording device to perform specific operations related to the string, for example, such as an operation of a mechanism included in the recording device, according to the status of recording a string in the data, for example, to the recording medium while recording to the recording medium. More particularly, because the control device can output data as usual to the recording device, and the recording device side automatically performs a specific mechanical operation timed to recording the specific string, there is no need to modify the control device.

Effect of the Invention

The present invention enables executing a specific operation when recording specific data to a recording medium while changing the control device as little as possible.

DESCRIPTION OF EMBODIMENTS

Preferred embodiments of the present invention are described below with reference to the accompanying figures.

Embodiment 1

Figure 1:
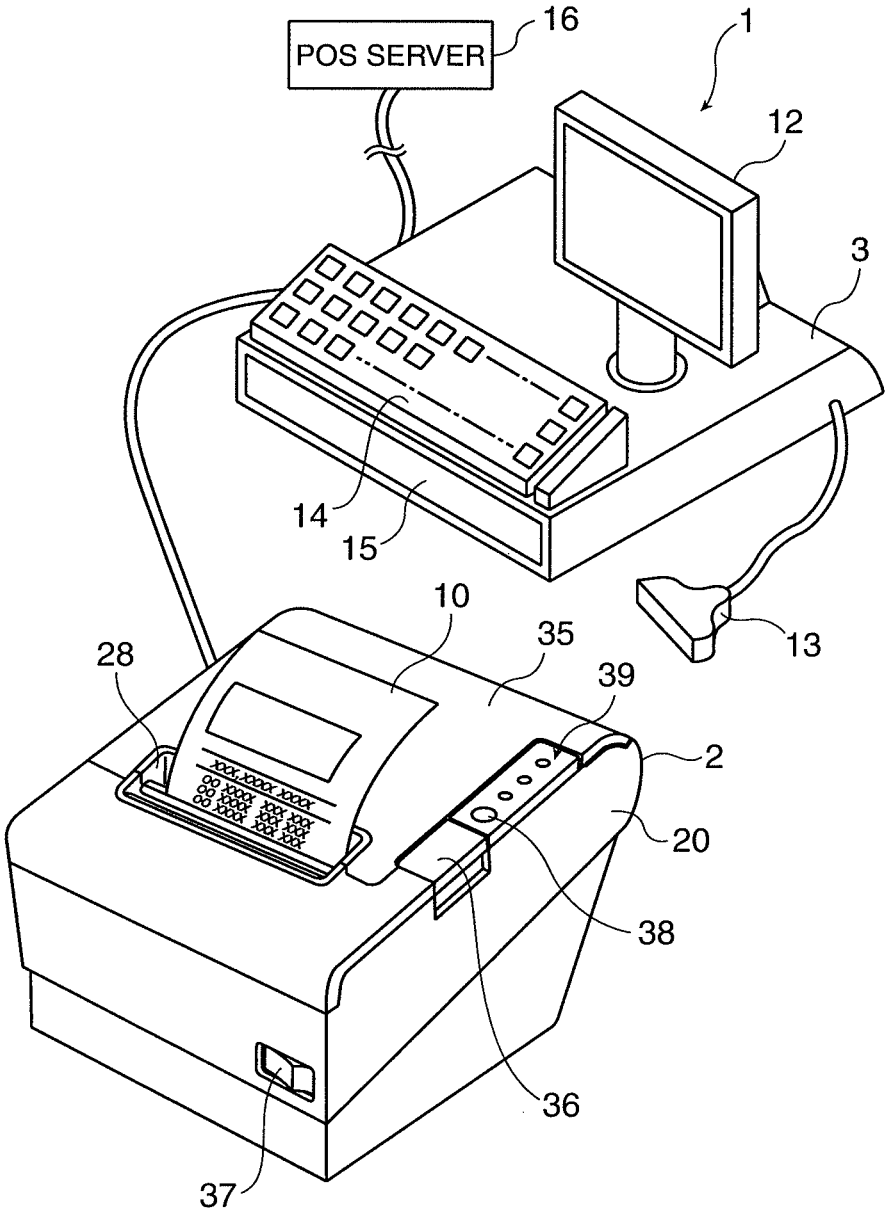
FIG. 1 shows the configuration of a POS terminal according to a first embodiment of the invention.

FIG. 1 shows the basic configuration of a POS terminal 1 according to a preferred embodiment of the invention.

Figure 2:
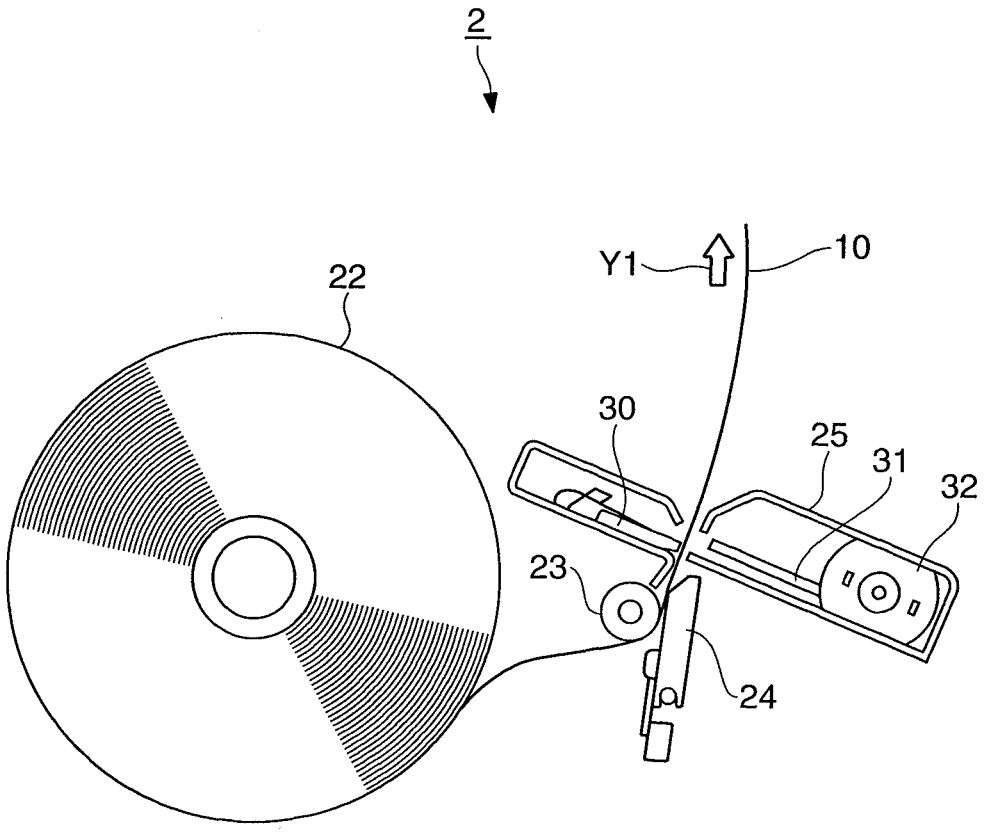
FIG. 2 shows part of the internal configuration of the printer.

FIG. 2 shows the internal configuration of a printer 2 (recording device) disposed to the POS terminal 1.

The POS terminal 1 shown in FIG. 1 is a terminal used in a point-of-sale (POS) system deployed in a retail store such as a supermarket or convenience store, for example, and includes a host computer 3 that processes sales transactions and payment processes, and a printer 2 that is connected to this host computer 3 and produces receipts 10 as controlled by the host computer 3.

The host computer 3 includes a display 12 that displays the content of the sale transaction process and payment process, a barcode scanner 13 that reads barcodes affixed to the products in the sale transaction process, a keyboard 14 with keys including an ENTER key, and a cash drawer 15 that stores cash used for payment processing. A POS server 16 that collects information entered in the sales transaction process is also connected to the host computer 3.

To issue a receipt 10, the host computer 3 accesses the POS server 16 to get the information needed to produce a receipt 10 based on input values from the barcode scanner 13 and input values from the keyboard 14, and generates and outputs to the printer 2 a control command that causes the printer 2 to perform the operation for issuing a receipt 10. The printer 2 then operates different parts thereof based on the control command input from the host computer 3, and produces a receipt 10.

As shown in FIG. 1 and FIG. 2, the printer 2 used as a recording device stores thermal roll paper 22 as the recording medium inside the printer case 20, and has a roller platen 23 (conveyance unit) that conveys the thermal roll paper 22, a recording head 24 disposed opposite the platen 23, and a cutter unit 25 (cutting unit) that cuts the thermal roll paper 22.

The printer 2 is a thermal line printer that records images by applying heat to the recording surface of the thermal roll paper 22 by driving the recording head 24, which has heat elements disposed in a line, to form dots on the recording surface of the thermal roll paper 22 while driving a paper feed motor 26 (FIG. 3) to rotate the platen 23 and convey the thermal roll paper 22 in the conveyance direction Y1. A control unit 50 described below, the paper feed motor 26, and platen 23 work together and function as a conveyance unit.

The thermal roll paper 22 on which an image was recorded is conveyed to the outside from a paper exit 28 formed in the top of the case 20, and is cut by the cutter unit 25 disposed on the upstream side of the paper exit 28 in the conveyance direction Y1, forming a receipt 10.

As shown in FIG. 2, the cutter unit 25 of the printer 2 has a fixed knife 30 disposed on one side of the thermal roll paper 22 conveyance path, a movable knife 31 disposed on the other side of the thermal roll paper 22 conveyance path opposite the fixed knife 30, and a cutter drive motor 32 that causes the movable knife 31 to slide against the fixed knife 30. The drive force of the cutter drive motor 32 causes the movable knife 31 to move toward the fixed knife 30 through an intervening drive mechanism (not shown in the figure) and cut the thermal roll paper 22 held between the fixed knife 30 and movable knife 31.

As also shown in FIG. 1, an openable cover 35 is disposed to the case 20 of the printer 2. A lever 36 for opening the cover 35 is also disposed to the case 20, and when the cover 35 is opened, the space that holds the thermal roll paper 22 is exposed and thermal roll paper 22 can be added or replaced. Also disposed to the case 20 are a power switch 37 for turning the printer 2 on and off, a paper feed switch 38 for manually advancing the thermal roll paper 22, and an LED panel 39 that displays the printer 2 status, errors, and other information by turning on or off in a specific pattern.

Figure 3:
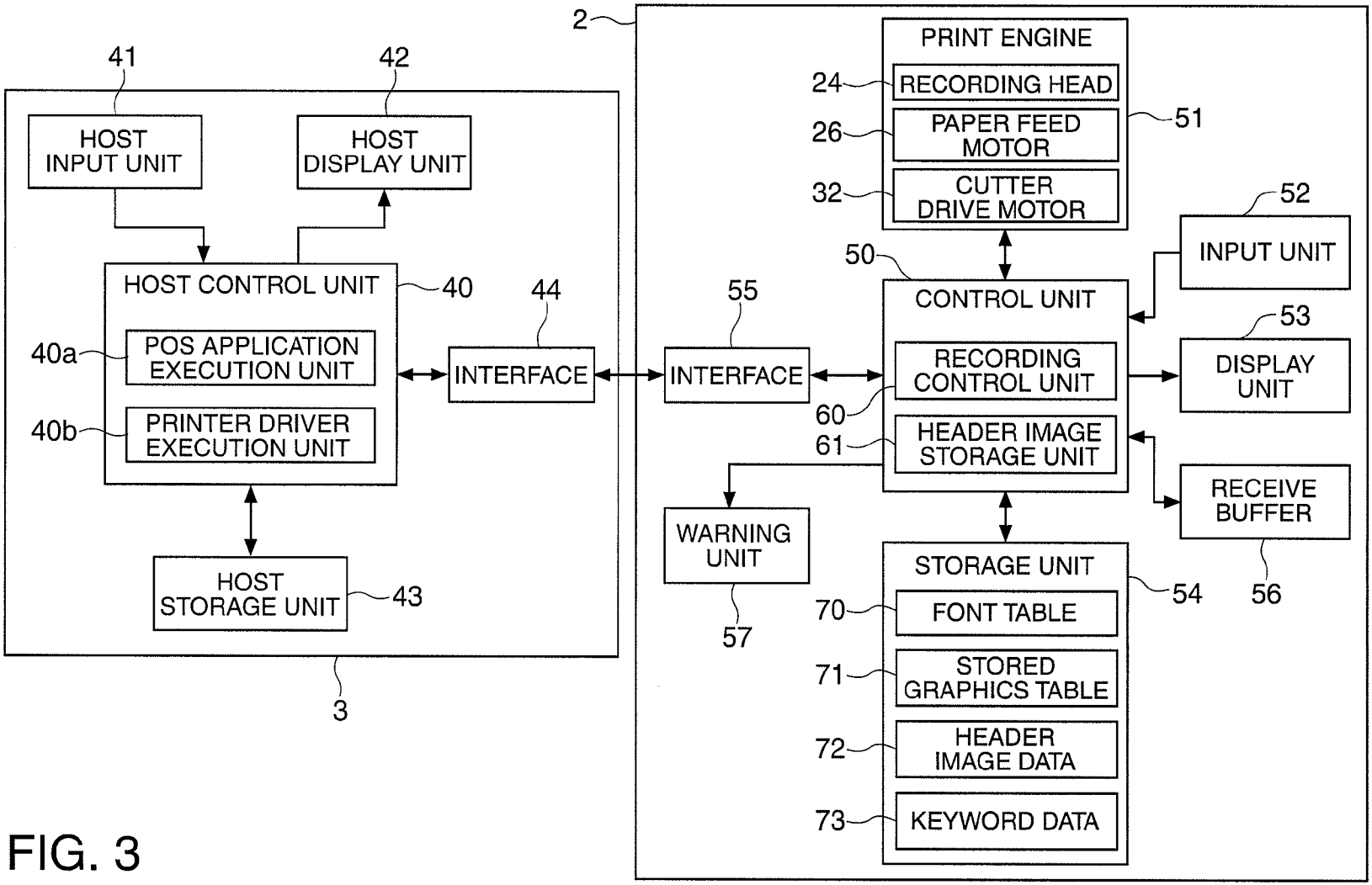
FIG. 3 is a block diagram showing the functional configuration of a POS terminal.

FIG. 3 is a block diagram showing the functional configuration of the POS terminal 1.

As shown in FIG. 3, the host computer 3 has a host control unit 40, host input unit 41, host display unit 42, host storage unit 43, and host-side interface 44.

The host control unit 40 centrally controls the host computer 3, and includes a CPU that runs programs, ROM that stores the basic control program run by the CPU, RAM used as working memory to temporarily store process data and programs run by the CPU, and other related peripheral circuits. The host control unit 40 includes a POS application execution unit 40*a* and printer driver execution unit 40*b*, which are further described below.

The host input unit 41 is connected to input devices including the foregoing keyboard 14, detects operation of the input devices, and outputs to the host control unit 40.

The host display unit 42 is connected to the display 12, and displays information including the content of the sales transaction process and payment process on the display 12 as controlled by the host control unit 40.

As described above, the host computer 3 is also connected to the barcode scanner 13, cash drawer, and other cash register peripherals. Interfaces for connecting these devices are installed to the host computer 3, and device drivers for controlling the devices are also previously installed.

The host storage unit 43 could be a hard disk drive or nonvolatile memory such as an EEPROM device, and nonvolatilely stores data rewritably.

The interface 44 communicates with the printer 2 according to a known communication protocol as controlled by the host control unit 40.

The printer 2 is a thermal line printer for printing receipts 10 as described above, and as shown in FIG. 3 has a control unit 50, print engine 51, input unit 52, display unit 53, storage unit 54, and interface 55.

The control unit 50 centrally controls other parts of the printer 2, and like the host control unit 40 described above includes a CPU, ROM, RAM, and other peripheral circuits.

The print engine 51 produces a receipt 10 by operating the recording head 24, paper feed motor 26, and cutter drive motor 32 as controlled by the recording control unit 60 of the control unit 50 to record an image on the thermal roll paper 22 and then cut the thermal roll paper 22 on which an image was recorded. Recording control unit 60 function is achieved by the cooperation of hardware and software, such as by the CPU reading and executing firmware or a program.

The input unit 52 is connected to the power switch 37 and paper feed switch 38, detects operation of these switches, and outputs to the control unit 50.

The display unit 53 outputs a drive signal to the LED panel 39 as controlled by the control unit 50, and causes the LED panel 39 to turn on/off in a specific pattern.

The storage unit 54 could be a hard disk drive or nonvolatile memory such as an EEPROM device, and nonvolatilely stores data rewritably. The data stored in the storage unit 54 is described below.

The interface 55 communicates with the host computer 3 according to a known communication protocol. The interface 55 and control unit 50 work together to function as a reception unit that receives control commands from the host computer 3.

A warning unit 57 including an electronic buzzer outputs a specific sound in a specific manner as controlled by the control unit 50.

The basic operation of the POS terminal 1 when producing one receipt 10 is described next while describing the POS application execution unit 40*a* and printer driver execution unit 40*b*.

By executing a POS application previously installed to the host computer 3, the POS application execution unit 40*a* acquires the information to be recorded on the receipt 10 (FIG. 4B), including information identifying the purchased products, product price information, and total purchase amount information, by accessing the POS server 16 and acquiring the necessary information for each transaction, generates print data including the image information to be recorded on the receipt 10 based on the acquired information, and outputs to the printer driver execution unit 40*b*.

By running the printer driver previously installed to the host computer 3, the printer driver execution unit 40*b* generates control commands in the command language used by the printer 2 based on the print data input from the POS application execution unit 40*a*, and outputs the control commands to the printer 2.

A control command is a group of commands that cause the printer 2 to perform the operations related to producing a receipt 10, and include a conveyance command HC for conveying the thermal roll paper 22 a specific paper feed distance, a cut command SC for cutting the paper with the cutter unit 25, and the recording data 80.

The recording data 80 (FIG. 4A) is image information to be recorded to the thermal roll paper 22, and more specifically is the content of the image to be recorded (such as text strings, particular graphics, barcode data), and information for recording the information in a particular order. Specific examples of the recording data 80 are described below.

The control commands output from the host computer 3 to the printer 2 are stored sequentially in the receive buffer 56.

The recording control unit 60 of the control unit 50 of the printer 2 controls the print engine 51 to perform operations related to producing a receipt 10 by sequentially reading and executing the control commands stored in the receive buffer 56. More specifically, the recording control unit 60 records a specific image on the thermal roll paper 22 and conveys the paper as needed for image recording by controlling the print engine 51 based on the recording data 80.

Specific examples of the recording data 80 and a receipt 10 on which an image is recorded based on the recording data 80 are described next.

Figures 4A, 4B:
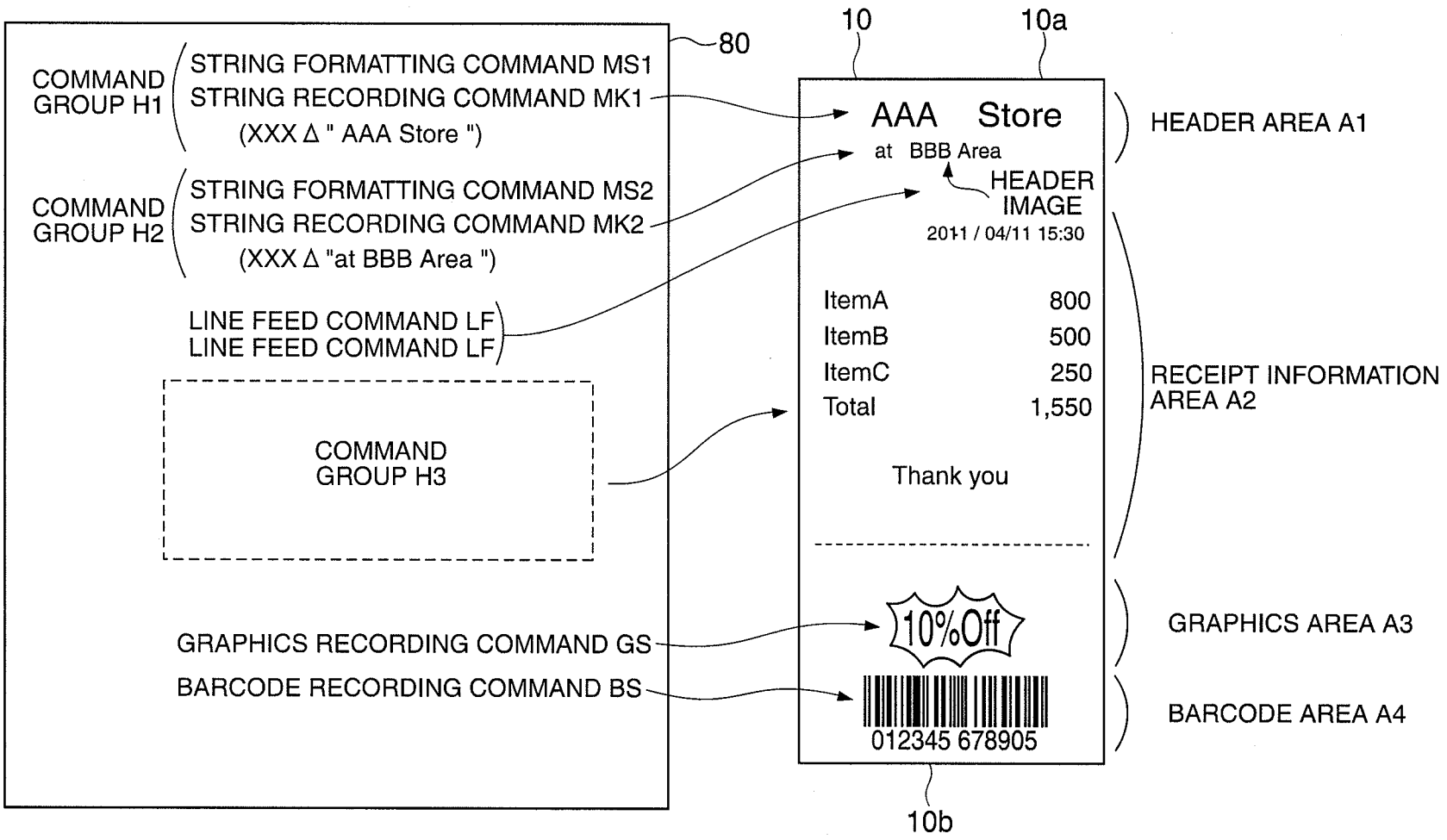
FIG. 4A and FIG. 4B show examples of recording data and a receipt.

FIG. 4A shows an example of the recording data 80 content, and FIG. 4B shows an example of a receipt 10 on which an image is recorded based on the recording data 80 shown in FIG. 4A.

The direction toward the top of the receipt 10 in FIG. 4B corresponds to the conveyance direction Y1. Therefore, after leading end 10*a* is formed by cutting the thermal roll paper 22, an image is formed by sequentially forming dots from the leading end 10*a* of the receipt 10 toward the trailing end 10*b* of the receipt 10, and the thermal roll paper 22 is then cut at the trailing end 10*b*, producing a receipt 10.

Other than specific exceptions, the layout of the receipts 10 produced by the printer 2 in this embodiment of the invention is basically the same for every receipt 10.

More specifically, as shown in FIG. 4B, a header area A1, receipt information area A2, graphics area A3, and barcode area A4 are formed sequentially on each receipt 10 from the leading end 10*a* to the trailing end 10*b*, that is, in the order recorded by the recording head 24.

The header area A1 is an area where a specific body of text is printed regularly in a specific format. In the receipt shown in FIG. 4B, the string "AAAΔStore" (where here and below Δ represents a space) is recorded centered (meaning the string is recorded in the middle of the width of the receipt 10) on the line at twice the standard character size, and the string "atΔBBBΔArea" is recorded centered on the next line at the standard character size.

Except for specific exceptions, the same text is recorded in the same format in the header area A1 of every receipt 10 produced by the printer 2. The two strings described above that are recorded in the header area A1 are referred to as the "header image" below. More specifically, the header image is the image related to the strings that are regularly recorded at the leading end of the receipt 10.

The receipt information area A2 is the area where the date and time the receipt 10 was printed, the names of purchased products, price prices, total purchase amount, and other additional information are recorded as text.

The graphics area A3 is an area where a specific graphic is recorded. These graphics are further described below.

The barcode area A4 is an area where a barcode is recorded.

As described above, the recording data 80 is data including the image information to be recorded on the thermal roll paper 22, and more specifically is data comprising commands for recording a specific image in a specific format on the thermal roll paper 22 arranged in the order to be recorded. The recording control unit 60 in the control unit 50 of the printer 2 sequentially reads and executes the commands in the recording data 80 to record images on the thermal roll paper 22 and convey the thermal roll paper 22 as required to record the images.

In FIG. 4A, command group H1 is the command group that records the string "AAAΔStore" contained in the two lines of text in the header image of the receipt 10 in a specific format, and includes two commands, a string formatting command MS1, and a string recording command MK1.

The string formatting command MS1 is a command that specifies the styles to be applied to the string "AAAΔStore", and more specifically is a command setting the character size to twice the standard size, and the text alignment to center aligned. Note that text styles mean applying some process related to drawing the text to be recorded, and in addition to such operations as enlarging the text or moving the position of the text, are equivalent to adding such attributes as reducing, rotating, adding emphasis, bold, or other styled characters or symbols.

The string recording command MK1 is a command telling the printer 2 to record the string "AAAΔStore". In this embodiment, the string recording command basically includes a command code and a string of a combination of characters written with specific character codes (such as ASCII codes). For example, the string recording command MK1 is XXXΔ"AAAΔStore" (where XXX is a command code for recording a string, and the string in double quotes is a string containing a combination of ASCII characters).

The recording control unit 60 controls the print engine 51 to record the string in the string recording command MK1 to the recording medium after applying the styles specified by the string formatting command MS1. As a result, the string "AAAΔStore" will be recorded center-aligned at twice the standard size as shown in FIG. 4B.

More specifically, a font table 70 is stored in the storage unit 54 of the printer 2. The font table 70 is a table that stores font data sets; the font data is the actual data expressing the characters in a format enabling recording to the thermal roll paper 22. The format of the font data in this embodiment of the invention is bitmap font data. In addition to bitmap font data, the font data could be stored as scalable font data, vector font data, or outline font data, for example.

Note that a "character" recorded to the thermal roll paper 22 in this embodiment of the invention is not limited to characters used for writing words (such as the alphabet), and conceptually includes any graphic symbol that can be recorded to the thermal roll paper 22 based on font data stored in the storage unit 54.

Characters expressed by ASCII codes correspond directly to font data stored in the font table 70, and information about this relationship is previously stored in the storage unit 54. For example, a table storing the relationship between each ASCII code and the location of the font data corresponding to each ASCII code (that address where the font data is stored in the font table 70) is previously stored in the storage unit 54.

To then record the string "AAAΔStore" based on the string formatting command MS1 and string recording command MK1, the recording control unit 60 references the font table 70 and the information describing the correlation between the ASCII code and the font data, gets the font data for each character in the string, applies the styling specified by the string formatting command MS1, and based on the acquired font data writes image data (bitmap data) for the string in the print buffer (not shown in the figure). Next, the recording control unit 60 records the string "AAAΔStore" by driving the recording head 24 and paper feed motor 26 based on the image data for the string written to the print buffer, and forming the dots composing an image of the string on the thermal roll paper 22.

Command group H2 following command group H1 is a group of commands for recording the string "atΔBBBΔArea" in a specific format, and in this embodiment includes a string formatting command MS2 that sets the size of the string to the standard size and specifies center aligning the string, and a string recording command MK2 that tells the printer 2 to record the string "atΔBBBΔArea".

Based on the commands contained in the command group H2, the recording control unit 60 controls the print engine 51 to record the string "atΔBBBΔArea" center aligned at the standard size as shown in FIG. 4B.

Two line feed commands LF follow the command group H2. As a result, as shown in FIG. 4B, two lines are inserted after the string "atΔBBBΔArea".

Command group H3 follows the two line feed commands LF. Command group H3 is a group of commands for recording an image in the receipt information area A2 of the receipt 10, and includes a string formatting command, a string recording command, and a line feed command. This command group H3 is described in further detail below.

A graphics recording command GS follows command group H3.

The recording control unit 60 records an image on the thermal roll paper 22 based on this graphics recording command GS.

More specifically, a stored graphics table 71 is stored in the storage unit 54 of the printer 2. This stored graphics table 71 stores image data for plural graphics related to a unique identification code assigned to each image. The image data for these graphics is bitmap data representing a specific image (graphics image) that is not an image recorded based on font data, such as bitmap data for the image recorded in graphics area A3 of the receipt 10 in FIG. 4B (an image drawing the string "10% Off" inside a styled bubble for emphasis).

The graphics recording command GS also contains information identifying the identification code of the graphics image to be recorded, and to record the graphic based on the graphics recording command GS, the recording control unit 60 references the stored graphics table 71 and gets the graphics image data identified by the identification code, writes the acquired image data to the print buffer, and controls the print engine 51 based on the buffered image data to record the graphics image.

Note that the graphics recording command GS could be written to contain the bitmap data for the image to the recorded in the graphics area A3, and cause the printer to record the image expressed by the bitmap data. In this case the recording control unit 60 writes the bitmap data contained in the graphics recording command GS to the print buffer, and then records the image.

A barcode recording command BS follows the graphics recording command GS.

The barcode recording command BS includes a command specifying the settings for the HRI (Human Readable Interpretation) line (whether to record the HRI, where to record the HRI relative to the barcode), a command specifying the size of the recorded barcode, and a command specifying the string to be converted to a barcode ("unconverted string") and directing recording a barcode image based on the unconverted string.

To record a barcode based on the barcode recording command BS, the recording control unit 60 gets the unconverted string contained in the barcode recording command BS, converts the unconverted string to a bitmap representation of the barcode image using a specific function rendered in firmware, writes the bitmap data representing the barcode image to the print buffer to reflect the HRI settings and barcode size settings, and then controls the print engine 51 based on the buffered bitmap data to record an image of the barcode and HRI on the thermal roll paper 22.

Figure 5:
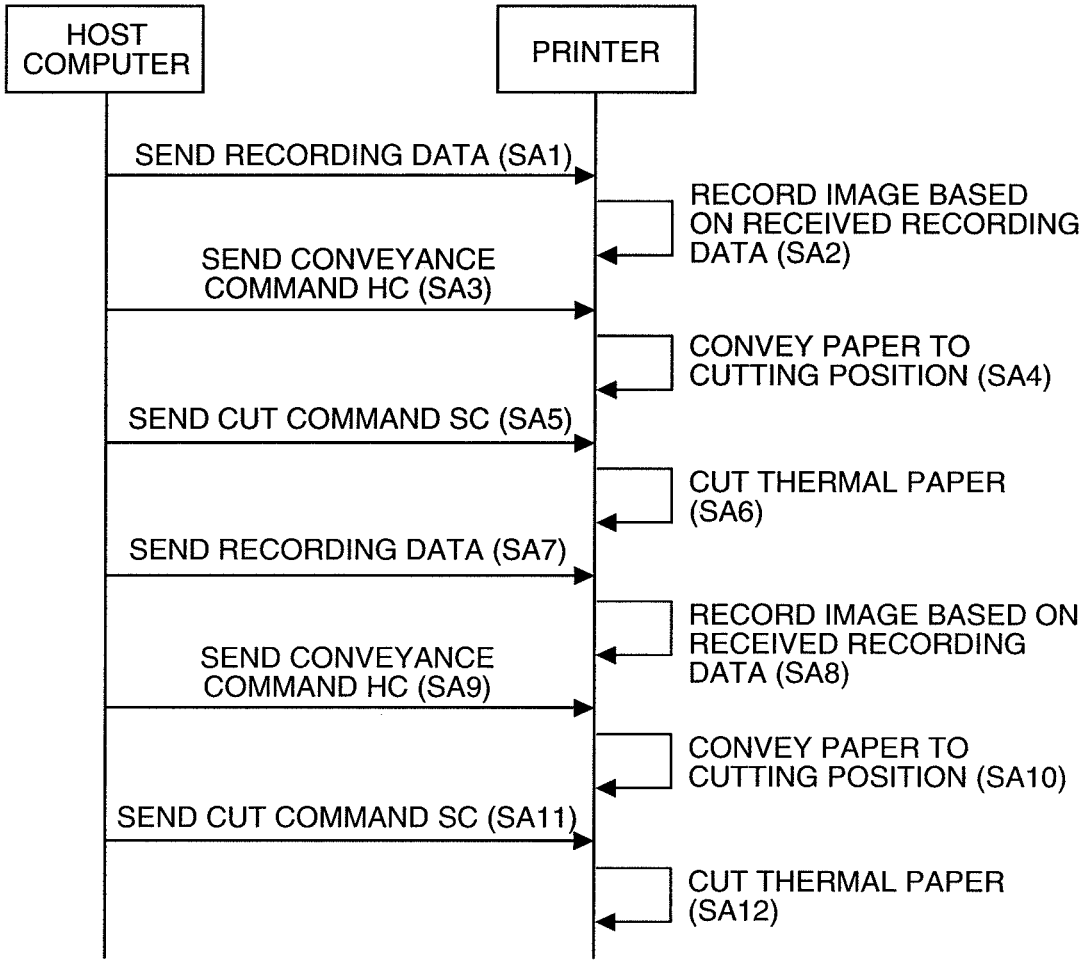
FIG. 5 is a sequence diagram of the printing operation performed by a host computer and printer according to the related art.

FIG. 5 is a sequence diagram describing the operation of the host computer 3 and the printer 2 of a POS terminal 1 according to the related art before using the invention.

To print a plurality of receipts 10 according to the related art, the printer 2 and host computer 3 perform their respective processes in the order described below.

More specifically, as shown in FIG. 5, the host computer 3 first sends the recording data 80 to the printer 2 (step SA1).

Next, based on the received recording data 80, the recording control unit 60 of the printer 2 records an image expressing the content of the recording data 80 on the thermal roll paper 22 (step SA2).

Next, the host computer 3 sends a conveyance command HC to the printer 2 for conveying the thermal roll paper 22 a specific distance so that the cutting position of the thermal roll paper 22 (the position where the thermal roll paper 22 should be cut to produce a receipt 10, referred to below as the "paper cutting position") goes to the cutting position T2 of the cutter unit 25 (the position where the cutter unit 25 cuts, that is, where the fixed knife 30 and movable knife 31 are located opposite each other and cut) (step SA3).

Figure 6:
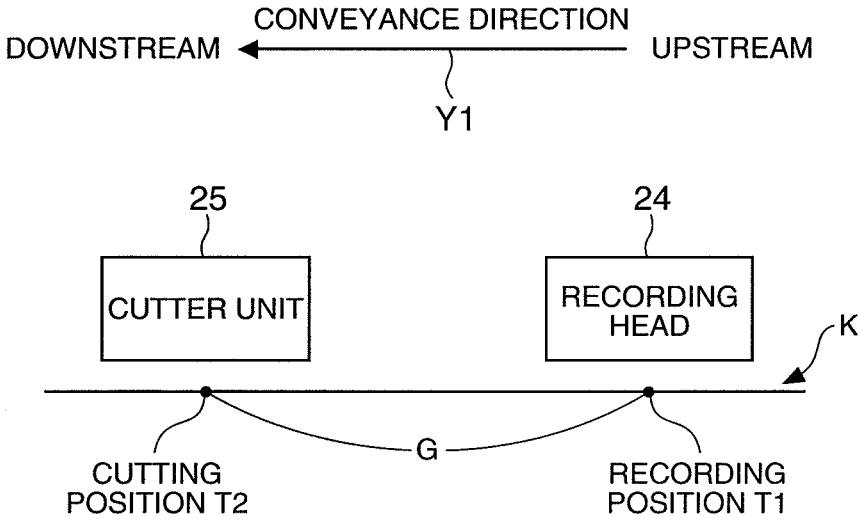
FIG. 6 schematically describes the relationship between the recording head and the cutter unit.

FIG. 6 schematically describes the relative positions of the recording head 24 and cutter unit 25.

As shown in FIG. 2 and FIG. 6, the recording head 24 is disposed to a specific position on the conveyance path (FIG. 6) through which the thermal roll paper 22 is conveyed, and the cutter unit 25 for cutting the thermal roll paper 22 is disposed downstream in the conveyance direction Y1 from the recording head 24.

As shown in FIG. 6, there is a gap G between the recording position T1 (the position where the heat elements are located) where images are recorded by the recording head 24, and the cutting position T2 of the cutter unit 25.

After the conveyance command HC is sent from the host computer 3 to the printer 2 in step SA3, the recording control unit 60 of the printer 2 controls the print engine 51 based on the received conveyance command HC to convey the thermal roll paper 22 a specific distance (step SA4).

Next, the host computer 3 sends a cut command SC to the printer 2 to cut the thermal roll paper 22 with the cutter unit 25 (step SA5).

Next, the recording control unit 60 of the printer 2 controls the print engine 51 and cuts the thermal roll paper 22 based on the received cut command SC (step SA6).

To produce a next receipt 10 after printing one receipt 10 as described above, the host computer 3 sequentially sends the recording data 80, conveyance command HC, and cut command SC, and the printer 2 sequentially executes the received commands (step SA7 to step SA12).

Problems resulting from printing a plurality of receipts 10 with the sequence of the related art described above are described below.

Figures 7A, 7B:
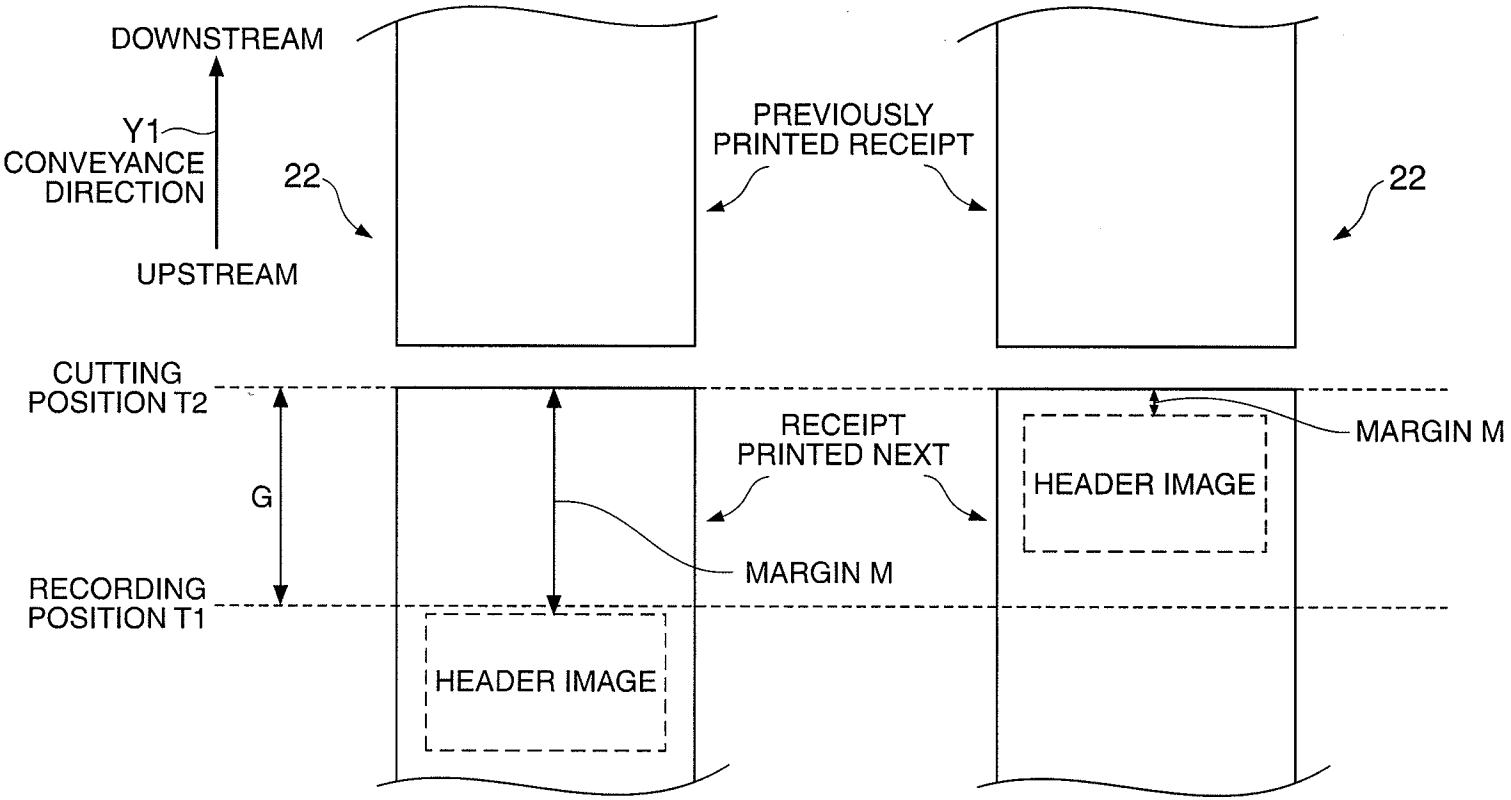
FIG. 7A and FIG. 7B show examples of receipts.

As described in FIG. 6, the recording sequence of the related art is a sequence whereby after recording an image based on the recording data 80 for a single receipt 10 is completed, the thermal roll paper 22 is cut after the thermal roll paper 22 is conveyed until the paper cutting position on the thermal roll paper 22 reaches the cutting position T2, and then recording an image based on the recording data 80 for the next receipt 10 starts. As a result, as shown in FIG. 7A and FIG. 7B, the margin M formed between the leading end 10*a* of the receipt 10 and the leading end of the header image recorded on the receipt 10 tends to increase due to the gap G in the conveyance direction Y1 between the recording position T1 of the recording head 24 and the cutting position T2 of the cutter unit 25.

Because this margin M is wasted space where nothing is recorded, the margin M is preferably shortened as much as possible to suppress wasteful consumption of thermal roll paper 22.

More specifically, there is a need to reduce the margin M without modifying the host computer 3 by, for example, changing a program, rewriting a program, replacing the host computer 3 itself, or modifying any of the component parts. This is because applying the invention to the POS terminal 1 is made easier by not needing to modify the host computer 3. In addition, when the POS terminal 1 is assembled by connecting a printer 2 to an existing host computer 3 previously installed in a store, the ability to simply purchase and install the printer 2 without needing to modify the host computer 3 offers advantages in terms of ease of installation and reliable connectivity for the store, and the advantage of greater added value in the printer 2 for the business that sells and provides the printer 2 (such as the printer manufacturer).

The printer 2 according to this embodiment of the invention therefore operates as described below.

Figure 8:
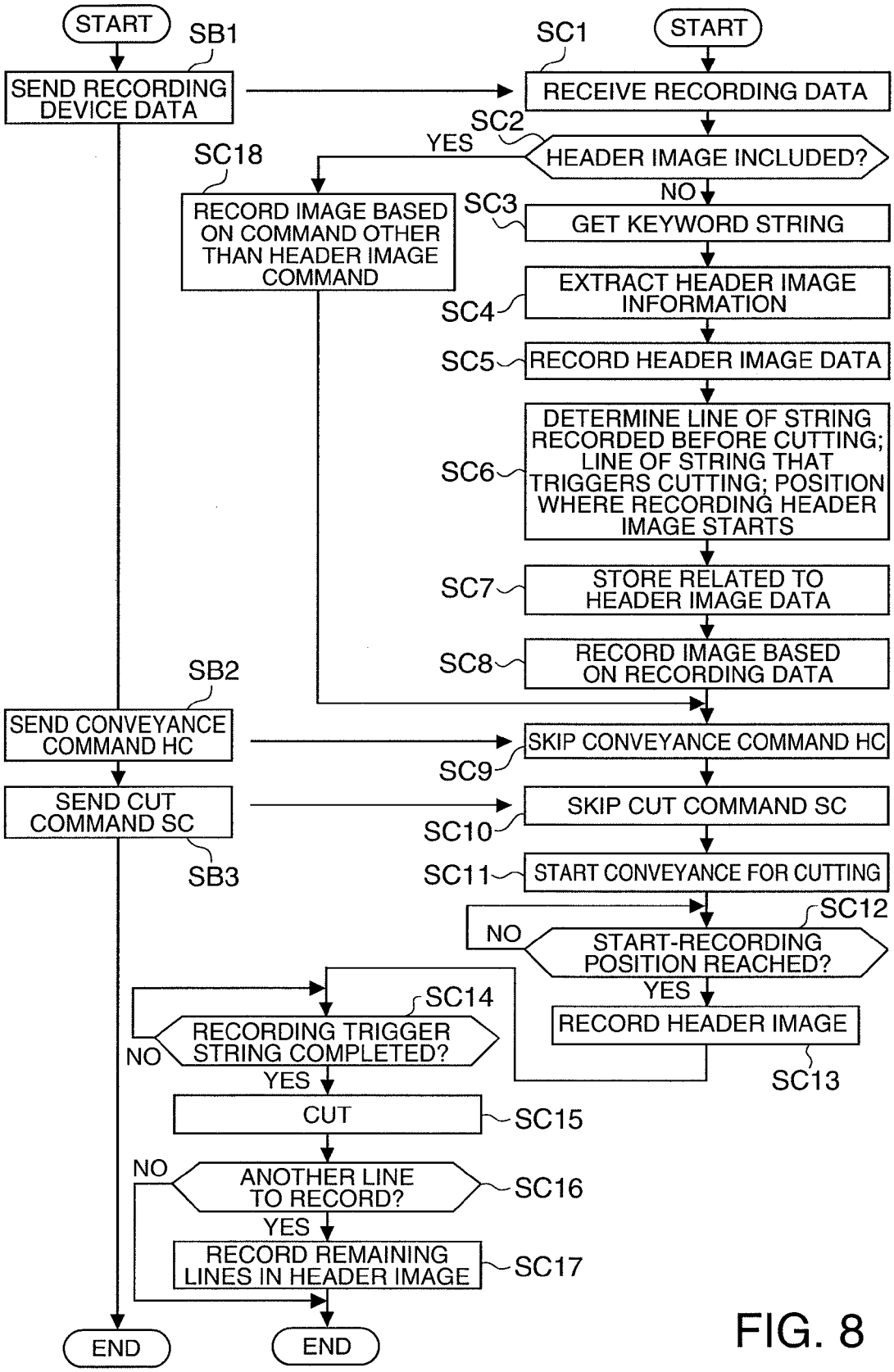
FIG. 8 is a flow chart of host computer and printer operation.

FIG. 8 is flow charts of the operation of a printer 2 according to this embodiment of the invention and a host computer 3, the flow of the left side showing the operation of the host computer 3 and the flow of the right side showing the operation of the printer 2.

FIG. 8 shows the operation of the printer 2 and the host computer 3 when printing one receipt 10.

As described above, the functions of the control unit 50, recording control unit 60, and header image storage unit 61 are achieved by the cooperation of hardware and software, such as a CPU reading and running firmware or a program.

As shown in FIG. 8, the host computer 3 first sends recording data 80 (step SB1).

Next, the printer 2 receives the recording data 80 sent by the host computer 3 (step SC1). The received recording data 80 is temporarily stored in the receive buffer 56.

Next, the header image storage unit 61 determines if header image data 72 (described below) is already stored in the storage unit 54 (step SC2).

Operation of the printer 2 when header image data 72 is not already stored in the storage unit 54 in step SC2 (step SC2 returns No) is described below.

Note that step SC2 returning NO assumes that a header image is not recorded at the leading end of the thermal roll paper 22. In addition to when header image data 72 is not stored in the storage unit 54, step SC2 will also return NO when a header image is not recorded at the leading end of the thermal roll paper 22 due to the timing when the thermal roll paper 22 is replaced, an error, or other reason even though header image data 72 is stored in the storage unit 54.

If header image data 72 is not yet stored in the storage unit 54 (step SC2 returns No), the header image storage unit 61 references keyword string data 73 stored in the storage unit 54 and gets a keyword string (step SC3). Keyword strings are described below.

Next, the header image storage unit 61 uses the keyword string acquired in step SC3, and extracts header image information from image information contained in the recording data 80 received in step SC1 (step SC4).

The operation of step SC4 is described next with reference to FIG. 4A and FIG. 4B.

As described above, a specific string is recorded in a specific format as a header image to the leading end (header) of the receipt 10 on all receipts 10 printed by the printer 2 in this embodiment of the invention. More specifically, the string "AAAΔStore" followed by the string "atΔBBBΔArea" are recorded on each receipt.

A keyword string is a string at the trailing end of a string in the header image. In the above example "Area" is a keyword string.

In step SC4, the header image storage unit 61 analyzes the recording data 80 stored in the receive buffer 56, and looks for a keyword string in the strings contained in each string recording command (a command including a specific command code and a string expressed by a group of characters represented by specific character codes). As described above, because a string is expressed by a group of characters represented by specific character codes in the string recording command, keyword strings can be found in the recording data 80 using an existing string search function.

Next, when recording an image based on the recording data 80, the header image storage unit 61 extracts a command sequence for recording a sequence of characters from the recording data 80 using the character string from the string recorded at the beginning of the image to the keyword string searched for as the header image, that is, as the string regularly recorded at the beginning of each receipt 10.

In the example in FIG. 4A, the commands in command group H1, which includes the command sequence for recording the string "AAAΔStore", and the commands in command group H2, which includes the sequence of commands for recording the string "atΔBBBΔArea", are extracted. The header image storage unit 61 thus extracts string formatting commands, which are commands specifying the formatting to be applied to the string, in addition to the string recording command.

The sequence of commands extracted as described above (the commands contained in command group H1 and command group H2 in this example) is "header image information."

After extracting the header image information in step SC4, the header image storage unit 61 stores the extracted header image information (command sequence) as header image data 72 in the storage unit 54 (step SC5).

Next, the recording control unit 60 determines which lines in the header image are lines on which strings are recorded in conjunction with conveyance to cut the recording medium (that is, the lines of the string to be recorded after conveyance for cutting the paper starts and before the thermal roll paper 22 is cut), the string that triggers cutting in the group of strings to be recorded, and the position on the thermal roll paper 22 where recording the strings of the header image starts (step SC6).

The operation of step SC6 is described below.

Figures 9A, 9B, 9C:
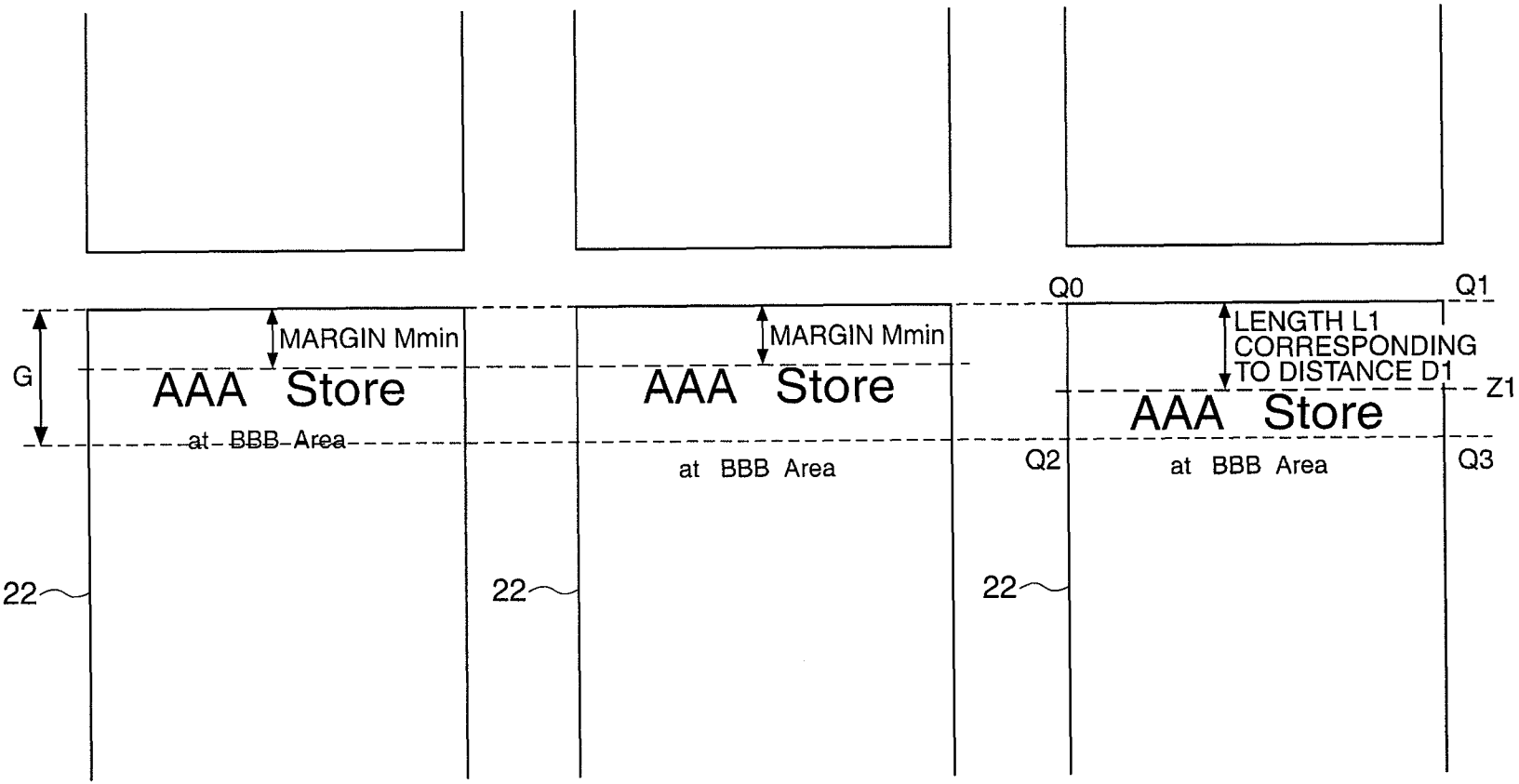
FIG. 9A, FIG. 9B, and FIG. 9C describe the relationship between the receipt and the header image.

FIG. 9A and FIG. 9B show a header image recorded in a specific format on the thermal roll paper 22 in order to describe the operation of step SC6.

As described above, an object of the invention is to reduce the margin M that is formed between the leading end 10*a* of the receipt 10 and the leading edge of the header image recorded on the receipt 10 due to the gap G in the conveyance direction Y1 between the recording position T1 of the recording head 24 and the cutting position T2 of the cutter unit 25.

To achieve this goal, the printer 2 reduces the margin M by recording the header image simultaneously to media conveyance when conveying the thermal roll paper 22 in the conveyance direction Y1 in order to cut the thermal roll paper 22 after recording an image based on the recording data 80 is completed as shown in FIG. 7B.

As a result, the relationship between the gap G and the header image on the thermal roll paper 22 is as shown in FIG. 9A. In FIG. 9A the distance between the leading end of the thermal roll paper 22 and the leading end of the header image is margin Mmin. This margin Mmin is the smallest margin required considering the balance between the borders of the receipt 10 and the printed image to achieve a desirable appearance in the receipt 10. The margin M can therefore be minimized by using margin Mmin as the margin M.

In the case shown in FIG. 9A, recording will be interrupted while still recording the string "atΔBBBΔArea" on the thermal roll paper 22, the thermal roll paper 22 cut, and after cutting is completed the remaining portion of the string "atΔBBBΔArea" will be recorded. Interrupting recording the string in this situation can result in white lines and misplaced dots in the recorded string and a drop in print quality. More specifically, physical contact with the cutter unit 25 when cutting the thermal roll paper 22 applies a certain amount of pressure to the thermal roll paper 22, creating a slight shift in the position of the thermal roll paper 22 before and after cutting, possibly resulting in white lines or misplaced dots.

The relationship between the gap G and the header image on the thermal roll paper 22 could also be as shown in FIG. 9B.

In FIG. 9B the gap between the string "AAAΔStore" and the string "atΔBBBΔArea" is greater than the gap expected by the recording data 80.

While this prevents a drop in print quality as shown in FIG. 9A, the appearance of the image recorded on the receipt 10 may be degraded by the greater than expected gap between the string "AAAΔStore" and the string "atΔBBBΔArea".

The relationship between the gap G and the header image on the thermal roll paper 22 could also be as shown in FIG. 9C.

This configuration can prevent the drop in print quality shown in FIG. 9A, and can prevent the degraded appearance shown in FIG. 9B.

Therefore, so that the header image is recorded as shown in FIG. 9C, step SC6 determines which of the plural strings in the header image should be recorded before cutting the thermal roll paper 22, and the timing for starting recording the header image.

This is further described below.

Figure 10:
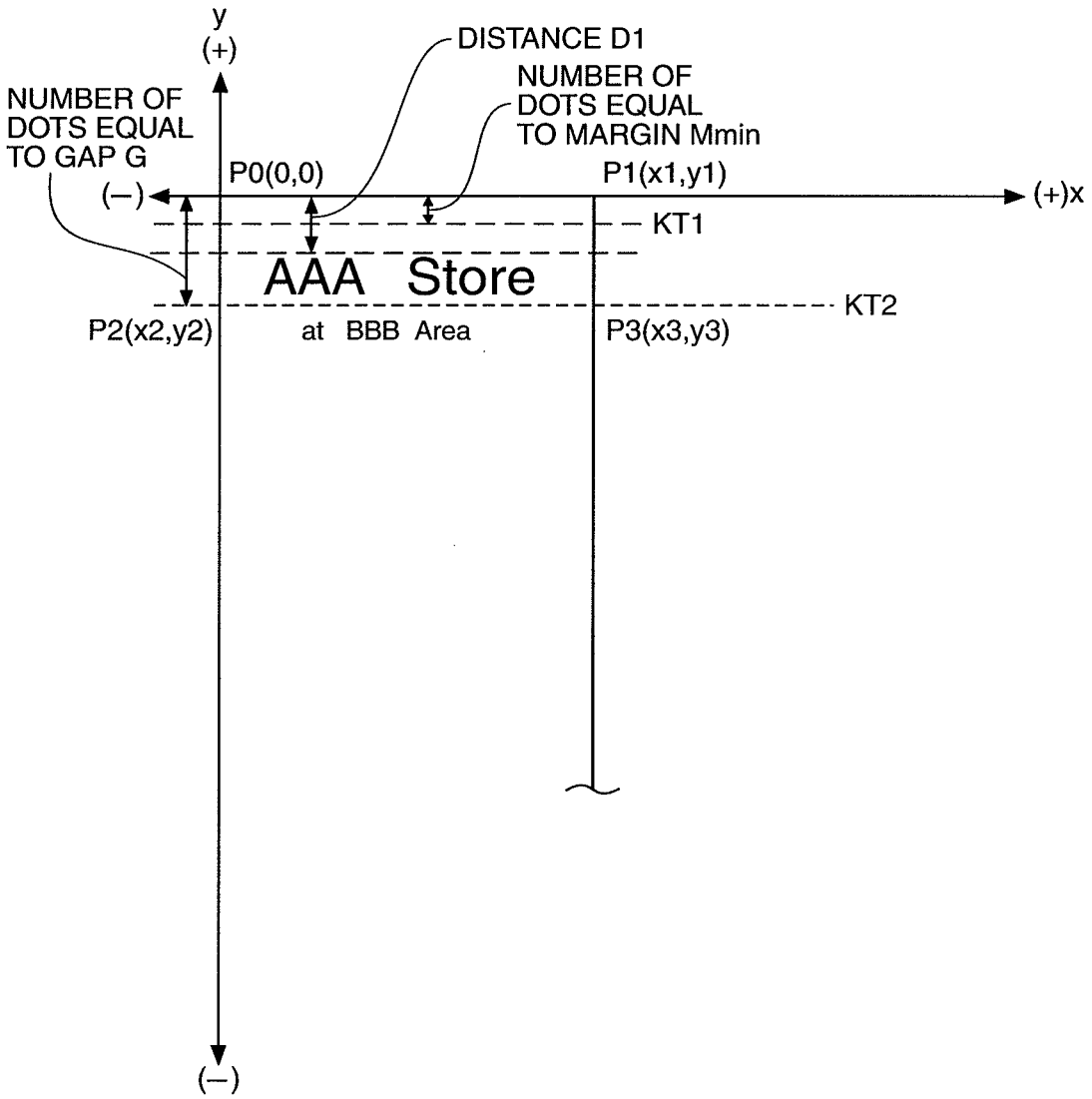
FIG. 10 shows the drawing data for the header image converted to a specific coordinate system.

FIG. 10 shows the pixels placed on the thermal roll paper 22 at the standard resolution of the printer 2 converted to a virtual coordinate system. The pixels in this coordinate system are arranged in a dot matrix based on the shape of the thermal roll paper 22, and each pixel can be identified based on the position relative to the origin.

Referring to FIG. 9 and FIG. 10, point Q0 in FIG. 9 corresponds to point P0 (0, 0) at the origin of the coordinate system; point Q1 corresponds to point P1 (x1, y1), which is a point on the x-axis; point Q2 corresponds to point P2 (x2, y2), which is a point on the y-axis; and point Q3 corresponds to point P3 (x3, y3). Point P1 is a point separated the number of dots equal to the width of the thermal roll paper 22 from the origin point P0 in the positive (+) x-axis direction; and point P2 is a point separated in the negative (−) y-axis direction from the origin P0 the number of dots equal to the gap G in the conveyance direction Y1 between the recording position T1 of the recording head 24 and the cutting position T2 of the cutter unit 25 in the printer 2. Point P3 is the point separated the number of dots equal to the gap G in the negative (−) y-axis direction from point P1, and the number of dots equal to the width of the thermal roll paper 22 in the positive (+) x-axis direction from point P2.

In step SC6, the control unit 50 first defines the coordinate system shown in FIG. 10 in a specific memory area.

Next, the control unit 50 writes the pixel data from the formatted header image (the "drawing data" below) to the coordinate system based on the header image data 72 stored in the storage unit 54 according to the following procedure.

More specifically, the control unit 50 writes the drawing data of the header image to the defined coordinate system so that the drawing data for strings on as many lines as possible are written to the area bounded by the virtual line KT1, which is separated the dot count equal to the margin Mmin from the x-axis, and the virtual line KT2, which connects point P2 and point P3, without changing the dot size of the space between strings and without drawing data for any string straddling virtual line KT2 (=a state in which virtual line KT2 is between the drawing data for any string and the drawing data for the next string, or a state in which the virtual line KT2 is on the negative (−) y-axis side of the negative (−) y-axis end of the drawing data for the string on the last line of the plural strings on plural lines in the header image).

For example, if the drawing data for the header image includes drawing data for the formatted string "AAAΔStore" and the drawing data for the formatted string "atΔBBBΔArea" separated a number of dots equal to the predetermined spaced from the first string, and the drawing data for all of the strings can be written to the range bounded by virtual line KT1 and virtual line KT2 without changing the number of dots equal to the space between the strings, the drawing data for all of the strings is written to this area.

If the number of dots on the y-axis of the drawing data for the header image including the space between strings is greater than the number of dots on the y-axis between virtual line KT1 and virtual line KT2 and the drawing data for all strings cannot be written to the area bounded by virtual line KT1 and virtual line KT2; and the number of dots on the y-axis of the drawing data for the string "AAAΔStore" is less than the number of dots on the y-axis between virtual line KT1 and virtual line KT2, and the drawing data for the string "AAAΔStore" cannot be written in that area; the drawing data for the strings is written to the coordinate system so that the virtual line KT2 is located in the space between the drawing data for the string "AAAΔStore" and the drawing data for the string "atΔBBBΔArea" as shown in FIG. 10. The string written to the area bounded by virtual line KT1 and virtual line KT2 is the string that is recorded after conveyance for cutting starts and before the media is cut, and the string written to the negative (−) y-axis side of the virtual line KT2 is a string that is recorded after cutting.

Using the coordinate system, the control unit 50 identifies the strings in the header image to be recorded before cutting so that as many strings as possible can be completely recorded after conveyance for cutting the thermal roll paper 22 starts and before the paper is cut.

Next, the control unit 50 detects the number of dots in the distance D1 (see FIG. 10) between the x-axis and the positive (+) y-axis end of the drawing data for the first string in the drawing data of the strings written to the coordinate system.

In the example in FIG. 10, the drawing data of the header image is written to the coordinate system so that the virtual line KT2 is between the drawing data for the string "AAAΔStore" and the drawing data for the string "atΔBBBΔArea." As shown in FIG. 9C, if recording the header image starts in this case from the position separated length L1 corresponding to distance D1 from the position where the thermal roll paper 22 was cut (leading end), the thermal roll paper 22 will be cut by the cutter unit 25 after recording the string "AAAΔStore" ends and before recording the string "atΔBBBΔArea" starts, recording the string "atΔBBBΔArea" starts thereafter, and the drop in print quality described with reference to FIG. 9A can be prevented.

In step SC6, the control unit 50, after writing the drawing data of the header image to the coordinate system as described above, determines the lines of the strings written to the area bounded by virtual line KT1 and virtual line KT2 to record to the thermal roll paper 22 after conveyance for cutting starts and before the media is cut.

Of the string lines to be recorded before the media is cut, the control unit 50 in step SC6 selects the string on the last line to be recorded before the media is cut as the string used to trigger cutting.

Next, in step SC6, the control unit 50 also sets the position separated length L1 (FIG. 9C) corresponding to distance D1 (FIG. 10) from the leading end of the thermal roll paper 22 as the position to start recording the header image (recording start position Z1, FIG. 9C).

Note that a table storing the number of dots in distance D1 in the coordinate system related to the length of the thermal roll paper 22 equal to length L1 is previously stored in a specific storage area, and based on this table the control unit 50 converts distance D1 to length L1. When the paper feed motor 26 is a stepper motor, for example, length L1 could be a value expressed by the number of steps the motor is driven.

The string that triggers cutting is described next.

In this example the drawing data for the header image is written to the coordinate system as shown in FIG. 10. In this case the line recorded to the thermal roll paper 22 after conveyance for cutting starts and before the media is cut is the string "AAAΔStore". In addition, the thermal roll paper 22 on which the header image is actually recorded is as shown in FIG. 9C. More specifically, the string "AAAΔStore" is recorded after conveyance for cutting starts and before the media is cut, the thermal roll paper 22 is cut after recording the string "AAAΔStore" ends and before recording the string "atΔBBBΔArea" starts, and the string "atΔBBBΔArea" is then recorded.

As a result, this embodiment cuts the thermal roll paper 22 after finishing recording the last string to be recorded in the group of strings to be recorded before the thermal roll paper 22 is cut, and to achieve this configuration as described above determines the lines of the strings to be recorded before cutting and determines the recording start position Z1 in step SC6. Of the strings to be recorded before cutting the thermal roll paper 22, the last string, that is, the string recorded immediately before cutting, is also selected in step SC6 as the string that triggers cutting. Note that as further described below the recording control unit 60 cuts the thermal roll paper 22 when triggered by recording this selected string, that is, when triggered by executing the string recording command for that string.

Referring again to FIG. 8, the header image storage unit 61 stores the lines of the strings recorded before cutting, the string that triggers cutting, and information denoting the position where recording the header image starts that were determined in step SC6 related to each other in the header image data 72 (step SC7).

Note that as described below the cutter unit 25 cuts when triggered by recording the string used as the cutting trigger. Therefore, a specific string (the string that triggers cutting) and a specific operation (cutting the thermal roll paper 22 by the cutter unit 25) are thus related to each other by recording the string that triggers cutting in step SC7. In this case, the storage unit 54 functions as a settings unit that stores the specific string (the string that triggers cutting) related to the specific operation (cutting the thermal roll paper 22 by the cutter unit 25).

Next, the recording control unit 60 controls the print engine 51 to record the images on the thermal roll paper 22 based on the recording data 80 (step SC8).

Next, the host computer 3 sends a conveyance command HC to the printer 2 as in the related art (step SB2). The recording control unit 60 of the printer 2 skips the received conveyance command HC (step SC9). The host computer 3 also sends a cut command SC to the printer 2 (step SB3), and the recording control unit 60 of the printer 2 also discards the received cut command SC (step SC10).

Because the host computer 3 is not modified in any way, the host computer 3 sequentially sends the recording data 80, conveyance command HC and cut command SC to the printer 2 as in the related art, but the printer 2 according to this embodiment of the invention conveys the recording medium for cutting and cuts according to the foregoing process that reduces the margin M without being controlled to do so by the host computer 3, and therefore ignores these commands. In addition, because a process that skips these commands is performed on the printer 2 side, the host computer 3 can continue to send commands according to the conventional method, and there is no need to modify the host computer 3.

Next, the recording control unit 60 of the printer 2 starts conveying the thermal roll paper 22 for cutting (step SC11).

During thermal roll paper 22 conveyance, the recording control unit 60 monitors if the recording start position Z1 (FIG. 9C) of the thermal roll paper 22 has reached the recording position T1 of the recording head 24 (step SC12). The printer 2 monitors the conveyance distance of the thermal roll paper 22 based on the number of steps the paper feed motor 26, which in this embodiment is a stepper motor, is driven; manages the recording start position Z1 and the location of the cutting position of the paper in the printer 2, based on this conveyance distance and output from a sensor that detects the position of the thermal roll paper 22; and based thereon can determine if the recording start position Z1 and the cutting position have reached the recording position T1 and cutting position T2.

If the recording start position Z1 on the thermal roll paper 22 has reached the recording position T1 of the recording head 24, the recording control unit 60, based on the header image data 72 in the storage unit 54 and the information about the lines to be recorded before cutting that was stored correlated to to the header image data 72 in step SC7, reads and executes the control commands for the strings to be recorded before cutting from among the strings for plural lines in the header image, and records the strings on those lines (step SC13).

For example, when the string "AAAΔStore" is the string to be recorded before cutting in the group of strings including the string "AAAΔStore" and the string "atΔBBBΔArea" as shown in FIG. 9C, the recording control unit 60 gets the text formatting command MS1 and string recording command MK1 that are the commands in command group H1 from among the commands contained in the header image data 72 in the storage unit 54, and by reading and executing these commands, records the string "AAAΔStore" to the paper feed distance of the thermal roll paper 22 after applying the specific formatting.

While thus sequentially recording the strings on the lines identified in step SC6 as lines to be recorded before cutting, the recording control unit 60 monitors, based on the information stored related to the header image data 72 in step SC7, if recording the strings is completed based on the string recording commands related to the string identified as the string that triggers cutting (=the last string recorded before cutting) in step SC6 (step SC14).

If string recording based on the string recording command is completed (step SC14 returns Yes), the recording control unit 60 stops conveying the thermal roll paper 22 and cuts the thermal roll paper 22 with the cutter unit 25 (step SC15). As a result, the thermal roll paper 22 is cut after recording all strings that should be recorded before cutting and before recording a new string starts, and the loss of print quality described in FIG. 9A can be prevented.

More specifically, the recording control unit 60 according to this embodiment of the invention is designed to perform the predetermined specific mechanical operation of cutting the thermal roll paper 22 when a string recording command related to recording a specific string that meets a specific condition is executed in the header image data 72, which is generated and stored based on a string recording command contained in recording data 80 received from a host computer 3 acting as a control device.

Next, the recording control unit 60 determines if there is a string in the header image that has not been recorded yet (step SC16), and if there is (step SC16 returns Yes), records the string on that line after applying specific formatting based on the control command related to the string on that line in the header image data 72 (step SC17).

Returning to step SC2, what happens when the header image data 72 is already stored in the storage unit 54 (step SC2 returns Yes) is described next.

When step SC2 returns YES, a header image is already recorded at the leading end of the thermal roll paper 22 based on header image data 72 stored in the storage unit 54. Whether a header image is recorded in conjunction with conveying the thermal roll paper 22 for cutting can be managed with a flag or detected by an optical detection means. This enables appropriately detecting if a header image has not been recorded on the thermal roll paper 22 due to some error or replacing the thermal roll paper 22, for example.

If the header image data 72 is already stored in the storage unit 54 (step SC2 returns Yes) the recording control unit 60 records an image based on the commands in the recording data 80 stored in the receive buffer 56 other than commands related to the header image (step SC18). For example, if the recording data 80 is as shown in FIG. 4A, the recording control unit 60 records an image by sequentially reading and executing commands other than command group H1 and command group H2. As a result, an image can be recorded without duplicating the header image.

Note that in step SC18 the recording control unit 60 identifies commands other than commands related to the header image in the group of commands contained in the recording data 80 based on a comparison of the header image data 72 stored in the storage unit 54 and the recording data 80 stored in the receive buffer 56.

After recording the image on the thermal roll paper 22 in step SC18, the recording control unit 60 goes to step SC9 and records a header image in conjunction with conveyance for cutting.

As described above, when a string recording command that specifies a string including a specific string is contained in the recording data 80, the recording control unit 60 according to this embodiment of the invention performs an operation predetermined as an operation related to the specific string in conjunction with executing the operation related to the string recording command.

More specifically, the recording control unit 60 according to this embodiment of the invention is configured to perform the predetermined specific mechanical operation of cutting the thermal roll paper 22 when executing a string recording command related to recording a specific string that meets a specific condition and is included in the header image data 72 generated and stored based on a string recording command contained in the recording data 80 received from the host computer 3 as a control device.

As a result, because the printer 2 performs an operation predetermined as an operation related to a specific string in conjunction with executing the operation related to the string recording command when a string recording command that specifies a string including the specific string is contained in the recording data 80, the printer 2 can perform a specific operation at a specific time according to the string recording command based on the configuration of string recording commands in the recording data 80 while recording to the thermal roll paper 22. More particularly, because the host computer 3 can output recording data 80 as usual to the printer 2, and the printer 2 side automatically performs a specific operation at a specific time coordinated to executing the string recording command, there is no need to modify the host computer 3.

In this embodiment of the invention the printer 2 also has a header image storage unit 61 that that stores a string recording command related to recording strings on one or more lines that are regularly recorded to the leading end part of the thermal roll paper 22 based on recording data 80 received from a host computer 3 as header image data 72. To cut the thermal roll paper 22 with the cutter unit 25, the recording control unit 60 conveys the thermal roll paper 22 in the conveyance direction Y1 while recording a string by the recording head 24 on the upstream side in the conveyance direction of the cutting position of the thermal roll paper 22 based on header image data 72 stored by the header image storage unit 61, and cuts the thermal roll paper 22 with the cutter unit 25 after recording based on a string recording command related to recording the last string (specific string) in the group of strings to be recorded before cutting contained in the string recording commands related to recording one or a plurality of strings contained in the header image data 72.

As a result, when the thermal roll paper 22 is cut, the margin M between the leading end of the thermal roll paper 22 and the leading end of the header image recorded on the thermal roll paper 22 due to the distance in the conveyance direction between the recording head 24 and cutter unit 25.

Embodiment 2

A second embodiment of the invention is described next.

Figures 11A, 11B:
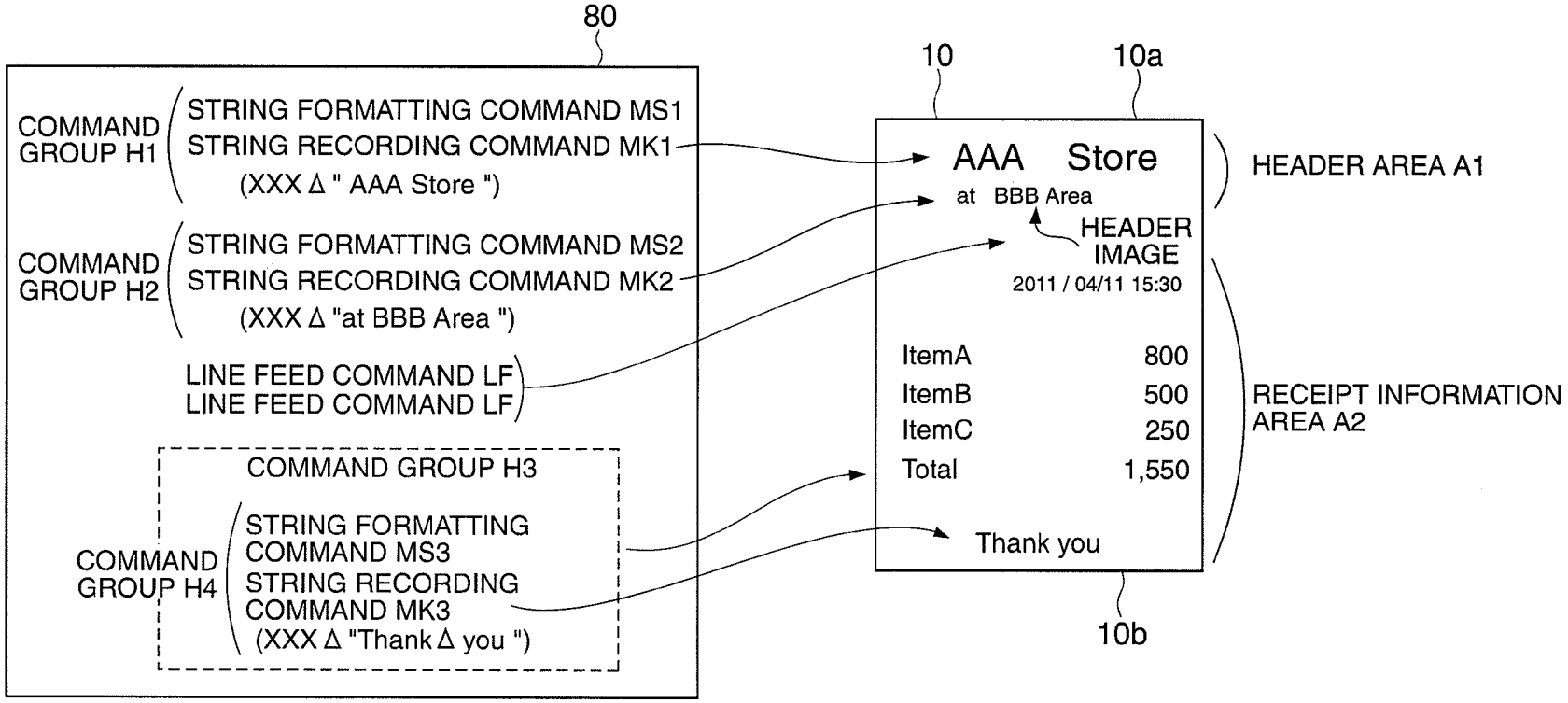
FIG. 11A and FIG. 11B show examples of recording data and a receipt in a second embodiment of the invention.

FIG. 11A and FIG. 11B show recording data 80 according to this embodiment of the invention and a receipt 10 on which an image is recorded based on the recording data 80.

As will be understood by comparing FIG. 11A and FIG. 11B with FIG. 4A and FIG. 4B, the layout of a receipt 10 according to the first embodiment of the invention differs from the layout of a receipt 10 according to this embodiment of the invention. More specifically, a receipt 10 according to this embodiment of the invention has a header area A1 and a receipt information area A2, and does not have a graphics area A3 and barcode area A4. As shown in FIG. 11B, the string "ThankΔyou" is also recorded at the end of the receipt 10 in this embodiment. This string is recorded in the same way on all receipts 10.

As a result, as shown in FIG. 11A, the command group H3 related to recording an image in the receipt information area A2 includes a command group 114 including a text formatting command MS3 related to recording the string "ThankΔyou" and a string recording command MK3.

The printer 2 according to this embodiment of the invention performs the process described below based on knowing that the string "ThankΔyou" is regularly recorded at the end of each receipt 10.

Figures 12A, 12B:
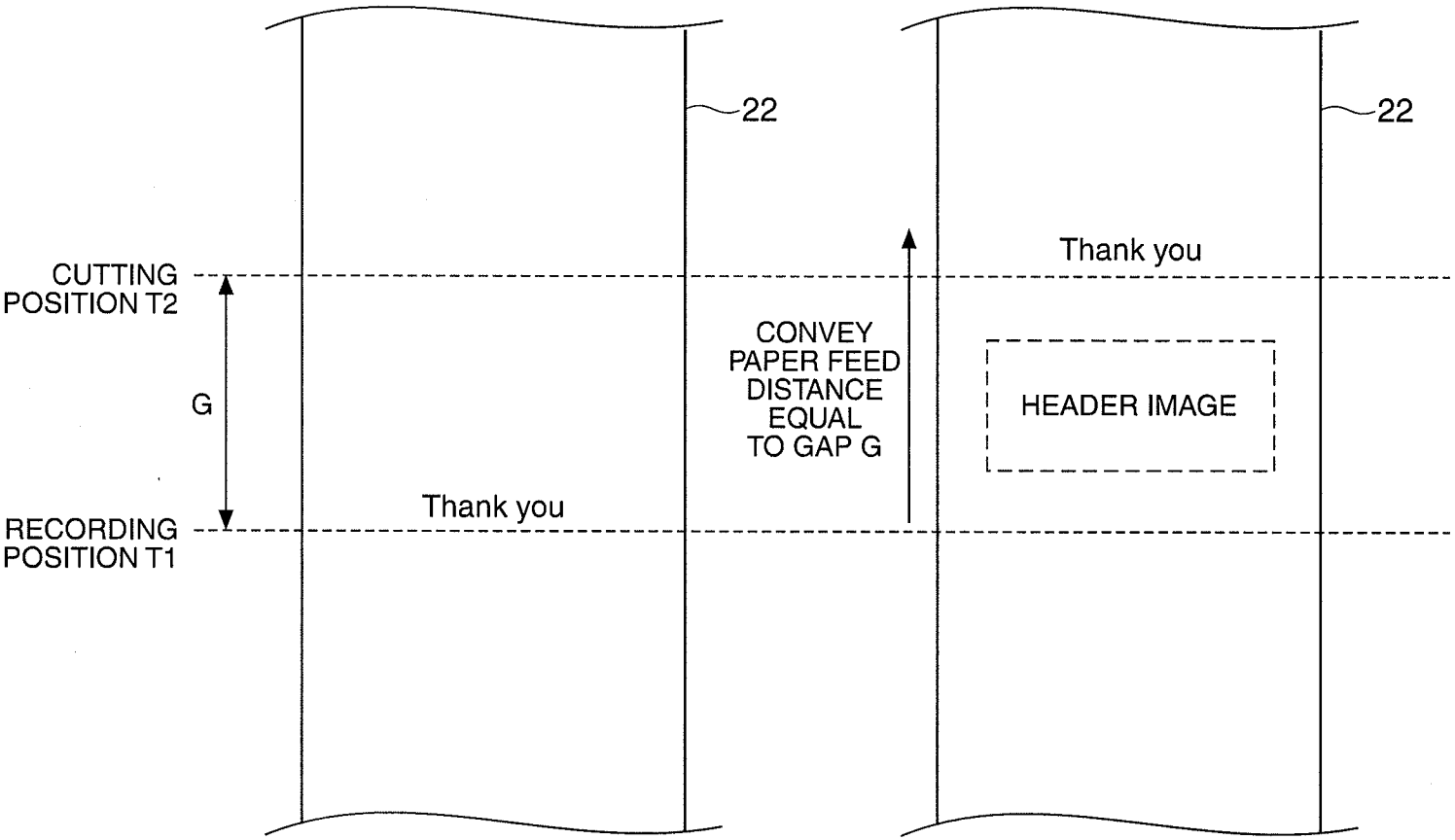
FIG. 12A and FIG. 12B describe printer operation.

FIG. 12A and FIG. 12B are used to describe the operation of a printer 2 according to this embodiment of the invention.

In this embodiment the storage unit 54 of the printer 2 stores the string "ThankΔyou" linked to information indicating cutting the thermal roll paper 22 with the cutter unit 25 after the thermal roll paper 22 is conveyed a distance equal to the gap G between the recording position T1 and cutting position T2 while recording the header image after recording the string "ThankΔyou". In this case, the storage unit 54 functions as a settings unit that stores one specific string linked to cutting the recording medium by the cutting unit after conveying the recording medium a specific conveyance distance by a conveyance unit while recording a specific image by the recording head 24.

When executing the string recording command and recording a specific string to record an image on the thermal roll paper 22 based on the recording data 80, the recording control unit 60 of the printer 2 determines using an existing string search if the string "ThankΔyou" is contained in the string specified by the string recording command. If the string "ThankΔyou" is contained in the string specified by the string recording command, the recording control unit 60 records the string "ThankΔyou" based on the string recording command, and then performs the operation described below based on information stored in the storage unit 54 of the printer 2.

That is, as shown in FIG. 12A and FIG. 12B, after recording the string "ThankΔyou" (see FIG. 12A), the recording control unit 60 conveys the thermal roll paper 22 the distance corresponding to the gap G while recording the header image at a specific position on the upstream side in the conveyance direction of the "ThankΔyou" string (FIG. 12B). As a result, the cutting position T2 is positioned to the cutting position of the thermal roll paper 22, which is on the upstream side in the conveyance direction of the string "ThankΔyou" and the downstream side in the conveyance direction from the leading end of the header image. The recording control unit 60 then drives the cutter unit 25 and cuts the thermal roll paper 22. Note that when conveying the thermal roll paper 22 for cutting and cutting, the recording control unit 60 ignores the conveyance command HC and cut command SC received from the host computer 3.

Triggered by recording the string "ThankΔyou" that is regularly recorded at the end of a receipt 10, the recording control unit 60 according to this embodiment of the invention thus performs the process of cutting the thermal roll paper 22 with the cutter unit 25 after a specific process related to the string, that is, after conveying the thermal roll paper 22 a distance equal to the gap G while recording the header image. As a result, the margin M can be shortened as in the first embodiment. In addition, knowing that the string "ThankΔyou" is recorded at the end of every receipt 10 can be used to cut the thermal roll paper 22 at a suitable position between the string "ThankΔyou" and the leading end of the header image.

Note that while this embodiment records the header image simultaneously to conveyance for cutting in order to shorten the margin M, a configuration that does not record the header image is also conceivable.

In this case, the storage unit 54 functioning as a settings unit stores the string "ThankΔyou" linked to information indicating cutting the thermal roll paper 22 with the cutter unit 25 after the thermal roll paper 22 is conveyed a distance equal to the gap G between the recording position T1 and cutting position T2 after recording the string "ThankΔyou".

This configuration also enables cutting the thermal roll paper 22 by the cutter unit 25 at an appropriate position on the upstream side of the string "ThankΔyou" after recording the string "ThankΔyou".

As described above, this embodiment of the invention stores, in the storage unit 54 that functions as a settings unit, the string "ThankΔyou" (one specific string) related to information for cutting the thermal roll paper 22 with the cutter unit 25 after conveying the thermal roll paper 22 with the conveyance unit a specific conveyance distance equal to gap G while recording the header image by the recording head 24. Triggered by recording the string based on the string recording command related to the string "ThankΔyou", the recording control unit 60 conveys the thermal roll paper 22 the specific distance corresponding to gap G while recording the image with the recording head 24, and then cuts the thermal roll paper 22 with the cutter unit 25.

As a result, the thermal roll paper 22 can be cut at an appropriate position between the string "ThankΔyou" and the leading end of the header image, and the margin M reduced.

Embodiment 3

A third embodiment of the invention is described next.

When a string recording command specifying a specific string is contained in the recording data 80 received from the host computer 3, the printer 2 according to this embodiment of the invention can convey the thermal roll paper 22 in the conveyance direction Y1 appropriately to the string recording command.

Figure 13A:
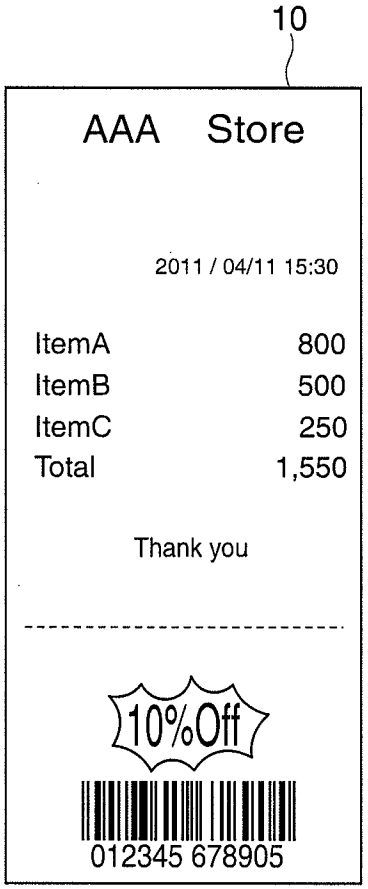
FIG. 13A and FIG. 13B show examples of receipts according to the third embodiment of the invention.
Figure 13B:
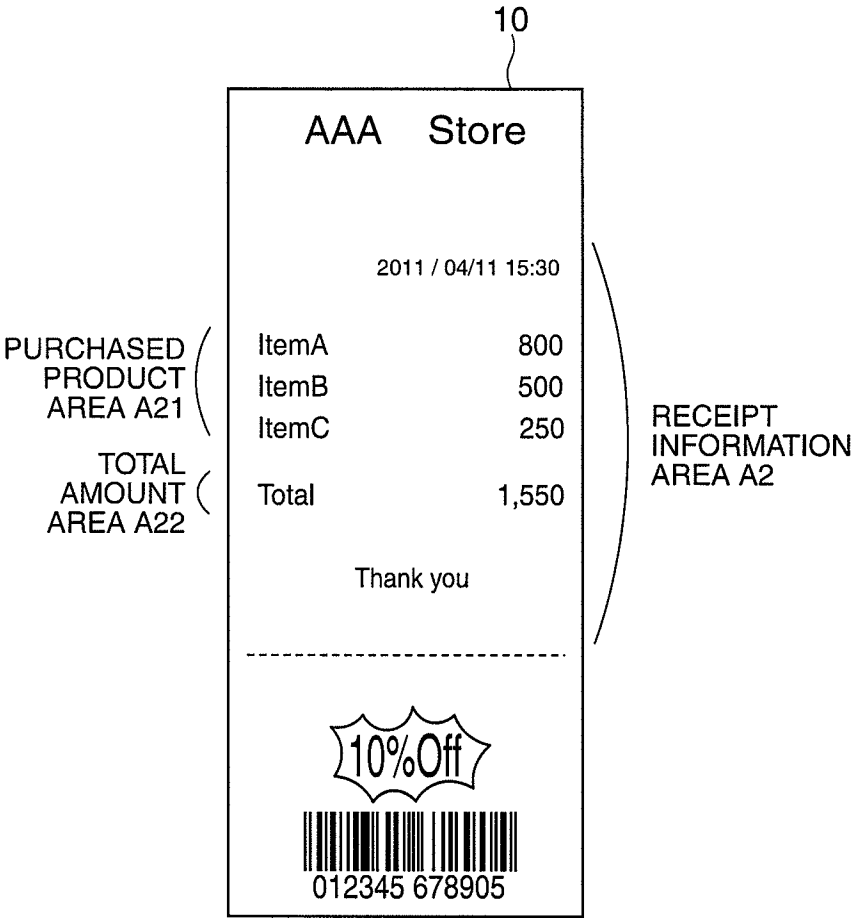

FIG. 13A and FIG. 13B show examples of a receipt 10 used to describe the operation of a printer 2 according to this embodiment of the invention.

The layout of a receipt 10 according to the related art is shown in FIG. 13A. As a result of the change described below, a one-line space is added between the purchased product area A21 and the total amount area A22 in the receipt information area A2 as shown in FIG. 13B. Note that the purchased product area is an area where a list of the names and prices of the products purchased by the customer are recorded, and the total amount area A22 is an area where the total transaction amount is recorded. The string "Total" is always recorded in this total amount area A22. Therefore, the recording data 80 contains a string recording command including the string "XXXΔTotalΔ000" (where "000" is any string).

This embodiment of the invention enables changing the layout as described above without making any change to the host computer 3.

Figure 14:
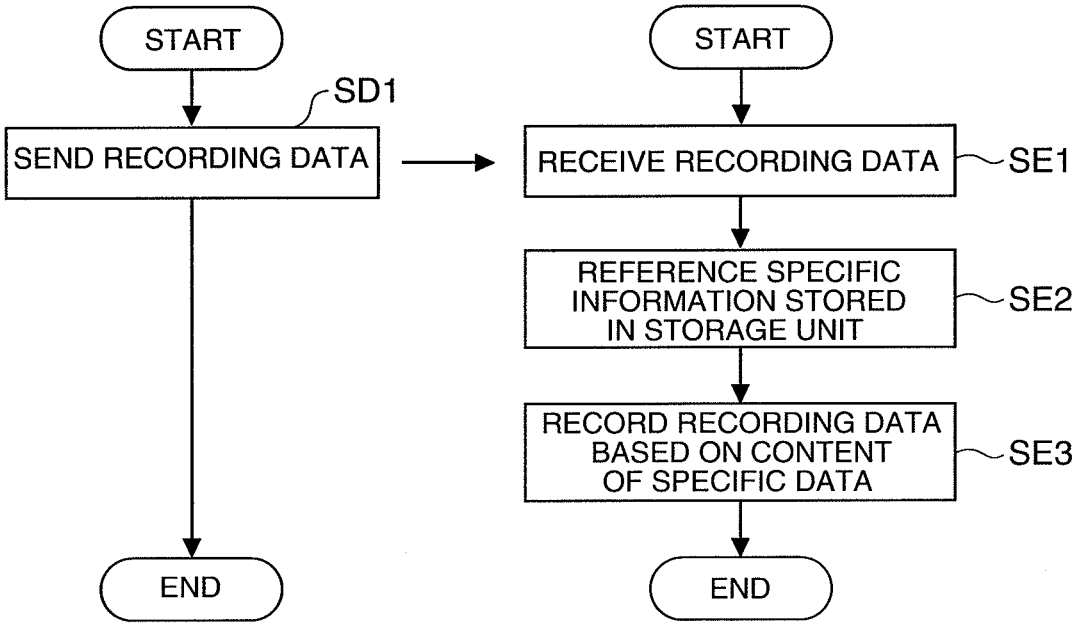
FIG. 14 is a flow chart of the operation of a POS terminal according to third, fourth, and fifth embodiments of the invention.

FIG. 14 is a flow chart of the operation of the host computer 3 and printer 2 when producing a receipt 10 after changing the layout as shown in FIG. 13A and FIG. 13B. The left side shows the operation of the host computer 3, and the right side shows the operation of the printer 2.

To produce a receipt 10, the host computer 3 sends recording data 80 contained in a control command to the printer 2 (step SD1).

The printer 2 then receives the recording data 80 (step SE1). The received recording data 80 is stored in the receive buffer 56.

Next, the recording control unit 60 of the printer 2 references specific data stored in the storage unit 54 (step SE2). This specific data is data that relates a specific string to a specific operation to be performed when executing a string recording command that specifies a string including the specific string. In this case, the storage unit 54 functions as a settings unit that stores specific strings related to specific operations. In this embodiment of the invention the string "Total" is stored related to information indicating conveying the thermal roll paper 22 one line before executing the string recording command related to recording the string including the string "Total". As shown in FIG. 13B, by conveying the thermal roll paper 22 one line before recording the string "Total", a space of one line is created between the purchased product area A21 and the total amount area A22.

When the layout of the receipt 10 is changed, the foregoing specific data must also be stored in the printer 2. However, there is no need to change the host computer 3.

Next, the recording control unit 60 of the printer 2 records an image on the thermal roll paper 22 based on the recording data 80 (step SE3). Based on the content of the referenced specific data, the printer 2 determines using an existing string search if the string "Total" is contained in the string specified by the string recording command when executing a string recording command and recording a specific string, and if the string "Total" is found, conveys the thermal roll paper 22 one line before executing the string recording command. As a result, a space of one line is formed between the purchased product area A21 and the total amount area A22.

More specifically, when a string recording command specifying a string containing the string "Total" is included in the recording data 80, the printer 2 according to this embodiment of the invention performs the mechanical operation of conveying the recording medium a predetermined one line amount timed to executing the operation related to the string recording command before executing the command, and by performing this operation accommodates changing the layout of the receipt 10 without changing the host computer 3.

As described above, when one string recording command that specifies a string including a specific string is included in the recording data 80, the recording control unit 60 conveys the thermal roll paper 22 timed to executing the operation related to the string recording command.

As a result, based on a string recording command that specifies a string including a specific string, the printer 2 can convey the thermal roll paper 22 at a desirable timing.

Embodiment 4

A fourth embodiment of the invention is described next.

When a string recording command specifying a specific string is contained in the recording data 80 received from the host computer 3, the printer 2 according to this embodiment of the invention causes a warning unit 57 to output sound timed to the string recording command.

By outputting sound, the warning unit 57 functions as an alarm unit that reports to the surroundings.

Described more specifically with reference to one example referring to FIG. 13A and FIG. 13B, ItemC is assumed to be a product to which sales restrictions apply, such as alcohol, tobacco, or other product that cannot be sold to minors. In this case, if inclusion of ItemC in the purchased products can be flagged by an audible alarm so that the person operating the cash register can be made aware, the operator can be reminded to perform a specific process, such as checking the age of the buyer, and convenience is improved.

To describe the operation of a printer 2 according to this embodiment of the invention with reference to FIG. 14, the printer 2 receives (step SE1) the recording data 80 sent from the printer 2 (SD1). The received recording data 80 is stored in the receive buffer 56.

Next, the recording control unit 60 of the printer 2 references specific data stored in the storage unit 54 (step SE2). This specific data is the string ItemC related to information for outputting a specific sound in a specific way by the warning unit 57 in conjunction with executing the string recording command related to recording the string containing the string ItemC. In this case, the storage unit 54 functions as a settings unit that stores specific strings related to specific operations.

Next, the recording control unit 60 of the printer 2 records an image on the thermal roll paper 22 based on the recording data 80 (step SE3). Based on the content of the referenced specific data, the printer 2 determines using an existing string search if the string "ItemC" is contained in the string specified by the string recording command when executing a string recording command and recording a specific string, and if the string is found, drives the warning unit 57 to output sound in a specific way timed to executing the string recording command. That ItemC was purchased can thus be reported.

More specifically, when a string recording command specifying a string containing the string "ItemC" is included in the recording data 80, the printer 2 according to this embodiment of the invention performs the mechanical operation of outputting a predetermined sound timed to performing the operation related to the string recording command, and by performing this operation enables outputting a specific sound in conjunction with purchase of ItemC without changing the host computer 3.

As described above, when one string recording command that specifies a string including a specific string is included in the recording data 80, the recording control unit 60 according to this embodiment of the invention outputs a sound from the warning unit 57 timed to executing the operation related to the string recording command.

As a result, based on a string recording command that specifies a string including a specific string, the printer 2 can output a sound at a desirable timing.

Embodiment 5

A fifth embodiment of the invention is described next.

When a string recording command specifying a specific string is contained in the recording data 80 received from the host computer 3, the printer 2 according to this embodiment of the invention controls the display unit 53 and displays specific information on the display 12 timed to the string recording command.

In this embodiment, the display unit 53 functions as a reporting unit that reports to the surroundings by displaying information.

Described more specifically with reference to one example referring to FIG. 13A and FIG. 13B, ItemC is assumed to be a product to which sales restrictions apply, such as alcohol, tobacco, or other product that cannot be sold to minors, or a product requiring some precaution, such purchasing another product is required to use the ItemC product. In this case, inclusion of ItemC in the purchased products can be displayed on the display 12 so that the person operating the cash register can be made aware, the operator can be reminded to perform a specific process, and convenience is improved.

To describe the operation of a printer 2 according to this embodiment of the invention with reference to FIG. 14, the printer 2 receives (step SE1) the recording data 80 sent from the printer 2 (SD1). The received recording data 80 is stored in the receive buffer 56.

Next, the recording control unit 60 of the printer 2 references specific data stored in the storage unit 54 (step SE2). This specific data is the string ItemC related to information for displaying information indicating that ItemC is included in the purchased products on the display 12 in conjunction with executing the string recording command related to recording the string containing the string ItemC. In this case, the storage unit 54 functions as a settings unit that stores specific strings related to specific operations.

Next, the recording control unit 60 of the printer 2 records an image on the thermal roll paper 22 based on the recording data 80 (step SE3). Based on the content of the referenced specific data, the printer 2 determines using an existing string search if the string "ItemC" is contained in the string specified by the string recording command when executing a string recording command and recording a specific string, and if the string is found, displays a message that ItemC was purchased on the display 12 timed to executing the string recording command. That ItemC was purchased can thus be reported.

More specifically, when a string recording command specifying a string containing the string "ItemC" is included in the recording data 80, the printer 2 according to this embodiment of the invention performs the predetermined operation of displaying information on the display 12 timed to performing the operation related to the string recording command, and by performing this operation enables displaying specific information in conjunction with purchase of ItemC without changing the host computer 3.

Note that instead of displaying information on the display 12, or in conjunction with displaying on the display 12, the printer 2 could also drive an LED panel 39 to turn on/off in a specific way.

As described above, when one string recording command that specifies a string including a specific string is included in the recording data 80, the recording control unit 60 according to this embodiment of the invention performs a specific display operation using the display unit 53 timed to executing the operation related to the string recording command.

As a result, based on a string recording command that specifies a string including a specific string, the printer 2 can perform a specific display operation at a desirable timing.

The foregoing embodiments describe preferred embodiments of the invention, and can be modified and applied as desired without departing from the scope of the invention.

For example, a configuration in which the user can perform a specific input operation on the host computer 3 to freely set the operation that the printer 2 should perform timed to executing a string recording command that specifies a string including a specific string is also conceivable. To achieve this configuration, the host computer 3 is configured to send specific commands including information describing the content input by the user. Based on the content of the specific command, the printer 2 receiving the specific command stores, for example, the specific string related to information about the operation to be performed in conjunction with executing the string recording command that specifies a string including the specific string in the storage unit 54. When executing the string recording command, the recording control unit 60 of the printer 2 determines if the specific string is contained in the string specified by the string recording command, and if it is, performs the defined specific operation in conjunction with executing the command. While this requires modifying the host computer 3, the printer 2 can be configured to perform a specific operation in conjunction with executing the string recording command by a simple means using the host computer 3, and convenience is greatly improved.

The functional parts shown in FIG. 3 can also be desirably achieved by cooperation between hardware and software components, and do not suggest any particular hardware configuration.

The foregoing embodiments describe the printer 2 having a control unit 50 with the recording control unit 60 and the header image storage unit 61, but the function of the control unit 50 could be rendered in a separate device externally connected to the printer 2, for example.

The invention is also not limited to a thermal printer, and can be applied to any type of printer, including an inkjet printer, a dot impact printer, a laser printer, or a dye sublimation printer. The printer could also be incorporated in an ATM or other device. The invention can also be used to record on media other than paper, including the label side of CD media or the label side of DVD media.

A program enabling applying the invention may also be included in a printer driver installed to the host computer 3.

Further alternatively, a program that executes the steps shown in the flow charts described above and is stored on an external storage medium of the printer 2 could be read and run by the control unit 50.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A recording device for printing receipts that is configured to connect to a control device, the recording device comprising:

a recording head configured to record on a recording medium in printing receipts of variable length;

a conveyance unit configured to convey the recording medium, wherein the recording head and conveyance unit are configured for printing receipts of variable lengths;

a cutting unit configured to cut the recording medium;

a reception unit configured to receive data from the control device;

a recording control unit configured to control the recording head and the conveyance unit and configured to record on the recording medium based on the data received by the reception unit; and a settings unit having a readable memory on which is stored a pre-determined specific print data linked to a pre-determined cutting position on the medium relative to the location of the specific print data printed on the medium, wherein the specific information corresponds to a header image printed on each receipt of the receipts of variable length, wherein the header image is defined by pixels in a dot matrix and the pre-determined cutting position is linked to the pre-determined specific information according to a pre-determined number of pixels between the cutting position and the header image, the pre-determined number of pixels corresponding to a desired margin or spacing;

wherein the recording control unit determines if the pre-determined specific print data stored in the settings unit is contained in the data received by the reception unit, and executes a cutting operation based on the cutting position linked to the specific print data in the settings unit so as to provide the desired margin or spacing between the specific print data printed on the medium and a cut end of the medium of the receipts of variable lengths when printing according to the data received from the control device without requiring modification of the data to set margins or spacing.

2. The recording device described in claim 1, wherein:

the settings unit stores a specific timing for performing the cutting operation according to the cutting position; and when the specific data stored in the settings unit is contained in the data received by the reception unit, the recording control unit performs the cutting operation linked to the specific data in the settings unit at the specific timing.

3. The recording device described in claim 1, wherein:

the settings unit stores the cutting operation related to a specific timing for cutting the recording medium by the cutting unit based on the cutting operation; and when the specific print data stored in the settings unit is contained in the data received by the reception unit, the recording control unit causes the cutting unit to cut the recording medium at the specific timing related to the cutting operation in the settings unit.

4. The recording device described in claim 1, wherein:

when the specific print data stored in the settings unit is contained in the data received by the reception unit, the recording control unit causes the cutting unit to cut the recording medium based on the cutting operation related to the specific print data in the settings unit at a specific timing referenced to the timing when the specific print data is recorded to the recording medium by the recording head.

5. The recording device described in claim 1, further comprising:

a cutting unit that cuts the recording medium; and a header image information storage unit that stores data including the specific print data received by the reception unit;

wherein the settings unit stores the specific print data stored by the header image information storage unit related to the recording medium cutting operation of the cutting unit; and when the specific print data stored in the header image information storage unit is contained in the data received by the reception unit, the recording control unit cuts the recording medium by the cutting unit based on the cutting operation related to the specific print data in the settings unit at a specific timing referenced to the timing when the recording head records the specific print data.

6. The recording device described in claim 5, wherein:

the cutting unit is located on the downstream side in the recording medium conveyance direction from the recording head; and when the specific print data stored in the header image information storage unit is contained in the data received by the reception unit, the recording control unit cuts the recording medium by the cutting unit based on the cutting operation related to the specific print data in the settings unit timed to the conveyance unit conveying the recording medium a specific distance after recording at least the specific print data.

7. The recording device described in claim 6, wherein:

the specific distance the conveyance unit conveys the recording medium is equal to the distance between the recording head and the cutting unit.

8. The recording device described in claim 1, further comprising:

a cutting unit that cuts the recording medium and is disposed on the downstream side in the recording medium conveyance direction from the recording head;

wherein the settings unit stores specific print data related to an operating sequence that cuts the recording medium by the cutting unit after the conveyance unit conveys the recording medium a specific conveyance distance; and when the specific print data stored in the settings unit is contained in the data received by the reception unit, the recording control unit, triggered by recording the specific print data, performs the cutting operation related to the specific print data in the settings unit.

9. The recording device described in claim 8, wherein:

the specific conveyance distance is the distance between the cutting unit and the recording head in the conveyance direction.

10. The recording device described in claim 1, wherein:

the settings unit stores specific print data related to conveyance of the recording medium by the conveyance unit; and when the specific print data is contained in the data received by the reception unit, the recording control unit conveys the recording medium by the conveyance unit according to the specific print data in the settings unit at a specific time referenced to the timing of the recording head recording the specific print data on the recording medium.

11. The recording device described in claim 10, wherein:

when a command specifying conveyance of the recording medium is received from the control device, the recording control unit does not convey the recording medium based on the command specifying conveyance of the recording medium.

12. The recording device described in claim 1, further comprising:

a warning unit;

wherein the settings unit stores first specific print data related to a warning by the warning unit; and when the first specific print data is contained in the data received by the reception unit, the recording control unit issues a warning by the warning unit related to the first specific print data in the settings unit.

13. The recording device described in claim 12, wherein:

the warning unit issues a warning by outputting sound or displaying information.

14. The recording device described in claim 1, wherein:

the settings unit stores the specific data related to the cutting operation based on a specific command received from the control device.

15. The recording device described in claim 1, wherein:

when a command specifying the cutting operation is received from the control device, the recording control unit does not execute the cutting operation based on the command specifying the specific operation.

16. The recording device described in claim 1, wherein:

when a command specifying the cutting operation is received from the control device, the recording control unit does not perform the cutting operation based on the command specifying the cutting operation.

17. A method of controlling a recording device that is configured to connect to a control device and includes a recording head that records on a recording medium for printing receipts of variable lengths, a conveyance unit that conveys the recording medium, a cutting unit that cuts the recording medium, a reception unit that receives recording data from the control device for printing on the medium, and a settings unit that stores pre-determined specific print data linked to a pre-determined cutting position on the medium relative the location of the specific print data printed on the medium, the control method comprising steps of:

receiving the recording data by the reception unit;

determining if the pre-determined specific print data stored in the settings unit is contained in the received data; and executing a cutting operation based on the cutting position linked to the specific print data in the settings unit if the specific print data is contained in the data received by the reception unit so as to provide a consistent margin or spacing between the specific print data printed on the medium and a cut end of the medium of the receipts of variable lengths based on the data received from the control device without requiring modification of the data to set margins or spacing, wherein the method is directed to printing of receipts with the recording device and the pre-determined specific information corresponds to a header image printed on each receipt, wherein the header image is defined by pixels in a dot matrix and the pre-determined cutting position is linked to the pre-determined specific information according to a pre-determined number of pixels between the cutting position and the header image, the pre-determined number of pixels corresponding to a desired margin or spacing, thereby consistently providing the desired margin or spacing when printing according to data received from the control device without requiring modification of the data to set margins or spacing.

18. The recording device control method described in claim 17, wherein:

the settings unit stores the cutting operation linked to a specific timing for performing the cutting operation; and when the specific print data stored in the settings unit is contained in the data received by the reception unit, the recording control unit performs the cutting operation linked to the specific print data in the settings unit at the specific timing related to the cutting operation in the settings unit.

19. The recording device control method described in claim 17, wherein:

the recording device also has a header image information storage unit that stores data including specific print data received by the reception unit;

the settings unit stores the specific print data stored by the header image information storage unit related to a recording medium cutting operation of the cutting unit; and when the specific print data stored in the header image information storage unit is contained in the data received by the reception unit, the recording control unit cuts the recording medium by the cutting unit based on the cutting operation related to the specific print data in the settings unit at a specific timing referenced to the timing when the recording head records the specific print data.

20. The recording device control method described in claim 17, wherein:

the recording device also has a cutting unit that cuts the recording medium and is disposed on the downstream side in the recording medium conveyance direction from the recording head;

the settings unit stores specific print data related to an operating sequence that cuts the recording medium by the cutting unit after the conveyance unit conveys the recording medium a specific conveyance distance; and when the specific print data stored in the settings unit is contained in the data received by the reception unit, the recording control unit, triggered by recording the specific print data, performs the cutting operation related to the specific print data in the settings unit.

21. The recording device control method described in claim 17, wherein:

the settings unit stores specific print data related to conveyance of the recording medium by the conveyance unit; and when the specific print data is contained in the data received by the reception unit, the recording control unit conveys the recording medium by the conveyance unit according to the specific print data in the settings unit at a specific time referenced to the timing of the recording head recording the specific print data on the recording medium.

22. A non-transitory tangible storage medium storing a program executed by a control unit that controls parts of a recording device configured to connect to a control device and includes a recording head that records on a recording medium for printing of receipts of variable lengths, a conveyance unit that conveys the recording medium, a reception unit that receives recording data from the control device for printing on the medium, a cutting unit that cuts the recording medium, and a settings unit that stores a pre-determined specific print data linked to a pre-determined cutting position on the medium relative the location of the specific print data printed on the medium, wherein the specific information corresponds to a header image printed on each receipt of the receipts of variable length, wherein the header image is defined by pixels in a dot matrix and the pre-determined cutting position is linked to the pre-determined specific information according to a pre-determined number of pixels between the cutting position and the header image, the pre-determined number of pixels corresponding to a desired margin or spacing, the program causing the control unit to function as a recording control unit that executes a cutting operation based on the cutting position linked to the pre-determined specific print data in the settings unit when the specific print data stored in the settings unit is contained in the data received by the reception unit so as to provide the desired margin or spacing between the specific print data printed on the medium and a cut end of the medium of the receipts of variable lengths when printing according to the data received from the control device without requiring modification of the data to set margins or spacing.

23. The method described in claim 17, wherein the method is directed to printing of receipts with the recording device and the pre-determined specific information comprises a header image printed on each receipt, the method further comprising:

recording the header image on the medium before cutting the medium at the cutting position, wherein the cutting position is downstream of the printed header image such that the header image on a next receipt is printed before cutting of a previously printed receipt thereby reducing wasted print space between sequential receipts.

24. The method described in claim 17, wherein the method is directed to printing of receipts with the recording device and the pre-determined specific information comprises one or more header images printed on each receipt, wherein the pre-determined cutting position is pre-determined such that cutting at the cutting position is performed either: after printing of the one or more header images is completed or between printing of images of the one or more header images so as to provide improved print quality of the one or more header images.

* * * * *